United States Patent [19]

Banerjee et al.

[11] Patent Number: 4,854,331

[45] Date of Patent: Aug. 8, 1989

[54] SMOKING ARTICLE

[75] Inventors: Chandra K. Banerjee, Pfafftown; Ernest G. Farrier, Winston-Salem; James L. Harris, Westfield; Alan B. Norman, Clemmons; James L. Resce, Yadkinville; John H. Reynolds, IV, Winston-Salem; Henry T. Ridings, Lewisville; Andrew J. Sensabaugh, Jr.; Michael D. Shannon, both of Winston-Salem; Gary R. Shelar, Greensboro, all of N.C.

[73] Assignee: R. J. Reynolds Tobacco Company, Winston-Salem, N.C.

[21] Appl. No.: 800,064

[22] Filed: Nov. 20, 1985

Related U.S. Application Data

[63] Continuation-in-part of Ser. No. 650,604, Sep. 14, 1984, Ser. No. 684,537, Dec. 21, 1984, and Ser. No. 769,532, Aug. 26, 1985.

[51] Int. Cl.[4] ..... A24D 1/18; A24D 1/00

[52] U.S. Cl. ..... 131/194; 131/360; 131/359; 128/202.21

[58] Field of Search ..... 131/270, 273, 360, 335, 131/364, 361, 362, 363, 359, 369, 194, 145; 128/202.21

[56] References Cited

U.S. PATENT DOCUMENTS

| | | |
|---|---|---|
| 198,075 | 12/1877 | Brisbane . |
| 1,529,181 | 1/1926 | Holmes . |
| 1,770,616 | 4/1930 | Kean . |
| 1,879,128 | 9/1932 | Desper . |
| 2,098,619 | 2/1936 | Finnell . |
| 2,178,820 | 8/1938 | Todoroff . |
| 2,471,116 | 8/1944 | Newberger . |

(List continued on next page.)

FOREIGN PATENT DOCUMENTS

| | | |
|---|---|---|
| 276250 | 7/1965 | Australia . |
| 687136 | 4/1968 | Canada . |
| 117355 | 8/1984 | European Pat. Off. . |
| 370692 | 2/1938 | France . |
| 998556 | 8/1954 | France . |
| 1264962 | 6/1977 | France . |
| 2057421 | 12/1984 | France . |
| 2057422 | 12/1984 | France . |
| 956544 | 12/1952 | United Kingdom . |
| 1185887 | 6/1973 | United Kingdom . |
| 1431045 | 4/1976 | United Kingdom . |

OTHER PUBLICATIONS

M. Sittig, Tobacco Substitutes (Noyes Data Corp. 1976).

Reynolds, "Influence of Filter Additives on Smoke Composition," Rec. Adv. Tob. Sci., 4:47 (1978).

Lyerly, "Direct Vapor Chromatographic Determination of *** Triacetin in Cigarette Smoke",: Tob. Sci., 50:26 (1967).

(List continued on next page.)

*Primary Examiner*—V. Millin

*Attorney, Agent, or Firm*—Grover M. Myers; David G. Conlin

[57] ABSTRACT

The present invention relates to a smoking article which produces an aerosol that resembles tobacco smoke, but contains no more than a minimal amount of incomplete combustion or pyrolysis products.

Preferred embodiments of the present smoking article comprise a short combustible carbonaceous fuel element, a heat stable substrate bearing an aerosol forming substance, a heat conducting member which contacts a portion of the fuel element and the substrate, and an insulating jacket surrounding at least a portion of the fuel element.

The smoking article of the present invention is capable of providing an aerosol "smoke" which is chemically simple, consisting essentially of air, oxides of carbon, water, and the aerosol which carries any desired flavorants or other desired volatile materials, and trace amount of other materials. The aerosol "smoke" from the preferred embodiments has no significant mutagenic activity as measured by the Ames Test. In addition, the article may be made virtually ashless so that the user does not have to remove any ash during use.

83 Claims, 5 Drawing Sheets

U.S. PATENT DOCUMENTS 2,809,704 6/1959 Lamm .
2,907,686 10/1959 Siegel .
2,976,190 4/1961 Myers .
2,998,012 8/1961 Lamm .
3,106,210 12/1965 Reynolds .
3,220,418 8/1965 Cohn .
3,258,015 6/1966 Ellis .
3,356,094 12/1967 Ellis .
3,516,417 6/1970 Moses .
3,550,598 11/1970 McGumphy .
3,586,005 10/1970 Lippman .
3,614,956 4/1971 Thornton .
3,710,805 1/1973 Tamaki .
3,713,451 2/1973 Bromberg .
3,738,374 3/1973 Bennett .
3,943,941 3/1976 Boyd .
4,027,679 8/1976 Kaswan .
4,044,777 8/1977 Boyd .
4,079,742 3/1978 Ranier .
4,219,031 1/1980 Rainer .
4,219,032 4/1980 Tabatznik .
4,284,089 8/1981 Ray .
4,286,604 9/1981 Ehretsman .
4,289,149 6/1981 Kyriakon .
4,326,544 4/1982 Hardwick .
4,340,072 7/1982 Bolt .
4,347,855 9/1982 Lanzillotti .
4,391,285 7/1983 Burnett .
4,407,308 10/1983 Baker et al. .
4,474,191 10/1984 Steiner .
4,480,650 11/1984 Weinert .
4,481,958 11/1984 Rainer .
4,553,556 11/1985 Lephardt .
4,570,650 2/1986 Sirota .
4,574,821 3/1986 Fischer .

OTHER PUBLICATIONS

Kiefer, et al., "Factors that Affect Elution of Plasticizer from Cigarette Filters," Eastman Kodak Pub. No. FTR-65.

Certain materials submitted to the Senate Committee on Commerce by Mr. Herbert A. Gilbert in Sep. of 1967.

Copy of newspaper article.

Guiness book of World Records, 1985 edition, pp. 242-243.

Guiness Book of World Records, 1966 edition, p. 194.

SMOKING ARTICLE

This is a continuation-in-part of application Ser. No 650,604, filed Sept. 14, 1984, application Ser. No. 684,537,filed Dec. 21, 1984, and application Ser. No. 769,532, filed Aug. 26, 1985, which applications are incorporated herein by reference.

BACKGROUND OF THE INVENTION

The present invention relates to a smoking article, preferably in cigarette form, which produces an aerosol that resembles tobacco smoke, and which preferably contains no more than a minimal amount of incomplete combustion or pyrolysis products.

Many smoking articles have been proposed through the years, especially over the last 20 to 30 years, but none of these products has ever realized any commercial success.

Tobacco substitutes have been made from a wide variety of treated and untreated plant material, such as cornstalks, eucalyptus leaves, lettuce leaves, corn leaves, cornsilk, alfalfa, and the like. Numerous patents teach proposed tobacco substitutes made by modifying cellulosic materials, such as by oxidation, by heat treatment, or by the addition of materials to modify the properties of cellulose. One of the most complete lists of these substitutes is found in U.S. Pat. No. 4,079,742 to Rainer et al. Despite these extensive efforts, it is believed that none of these products has been found to be satisfactory as a tobacco substitute.

Many smoking articles have been based on the generation of an aerosol or a vapor. Some of these products purportedly produce an aerosol or a vapor without heat. See, e.g., U.S. Pat. No. 4,284,089 to Ray. However, the aerosols or vapors from these articles fail to adequately simulate tobacco smoke.

Some proposed aerosol generating smoking articles have used a heat or fuel source in order to produce an aerosol. However, none of these articles has ever achieved any commercial success, and it is believed that none has ever been widely marketed. The believed that none has ever been widely marketed. The absence of such smoking articles from the marketplace is believed to be due to a variety of reasons, including insufficient aerosol generation, both initially and over the life of the product, poor taste, off-taste due to the thermal degradation of the smoke former and/or flavor agents, the presence of substantial pyrolysis products and sidestream smoke, and unsightly appearance.

One of the earliest of these proposed articles was described by Siegel in U.S. Pat. No. 2,907,686. Siegel proposed a cigarette substitute which included an absorbent carbon fuel, preferably a 2½ inch (63.5 mm) stick of charcoal, which was burnable to produce hot gases, and a flavoring agent carried by the fuel, which was adapted to be distilled-off incident to the production of the hot gases. Siegel also proposed that a separate carrier could be used for the flavoring agent, such as a clay, and that a smoke-forming agent, such as glycerol, could be admixed with the flavoring agent. Siegel's proposed cigarette substitute would be coated with a concentrated sugar solution to provide an impervious coat and to force the hot gases and flavoring agents to flow toward the mouth of the user. It is believed that the presence of the flavoring and/or smoke-forming agents in the fuel of Siegel's article would cause substantial thermal degradation of those agents and an attendant off-taste. Moreover, it is believed that the article would tend to produce substantial sidestream smoke containing the aforementioned unpleasant thermal degradation products.

Another such article was described by Ellis et al. in U.S. Pat. No. 3,258,015. Ellis et al. proposed a smoking article which had an outer cylinder of fuel having good smoldering characteristics, preferably fine cut tobacco or reconstituted tobacco, surrounding a metal tube containing tobacco, reconstituted tobacco, or other source of nicotine and water vapor. On smoking, the burning fuel heated the nicotine source material to cause the release of nicotine vapor and potentially aerosol generating material, including water vapor. This was mixed with heated air which entered the open end of the tube. A substantial disadvantage of this article was the ultimate protrusion of the metal tube as the tobacco fuel was consumed. Other apparent disadvantages of this proposed smoking article include the presence of substantial tobacco pyrolysis products, the substantial tobacco sidestream smoke and ash, and the possible pyrolysis of the nicotine source material in the metal tube.

In U.S. Pat. No. 3,356,094, Ellis et al. modified their original design to eliminate the protruding metal tube. This new design employed a tube made out of a material, such as certain inorganic salts or an epoxy bonded ceramic, which became frangible upon heating. This frangible tube was then removed when the smoker eliminated ash from the end of the article. Even though the appearance of the article was very similar to a conventional cigarette, apparently no commercial product was ever marketed.

In U.S. Pat. No. 3,738,374, Bennett proposed the use of carbon or graphite fibers, mat, or cloth associated with an oxidizing agent as a substitute cigarette filler. Flavor was provided by the incorporation of a flavor or fragrance into the mouth-end of an optional filter tip.

U.S. Pat. Nos. 3,943,941 and 4,044,777 to Boyd et al. and British Patent No. 1,431,045 proposed the use of a fibrous carbon fuel which was mixed or impregnated with volatile solids or liquids which were capable of distilling or subliming into the smoke stream to provide "smoke" to be inhaled upon burning of the fuel. Among the enumerated smoke producing agents were polyhydric alcohols, such as propylene glycol, glycerol, and 1,3-butylene glycol, and glyceryl esters, such as triacetin. Despite Boyd et al.'s desire that the volatile materials distill without chemical change, it is believed that the mixture of these materials with the fuel would lead to substantial thermal decomposition of the volatile materials and to bitter off-tastes. Similar products were proposed in U.S. Pat. No. 4,286,604 to Ehretsmann et al. and in U.S. Pat. No. 4,326,544 to Hardwick et al.

Bolt et al., in U.S. Pat. No. 4,340,072, proposed a smoking article having a fuel rod with a central air passageway and a mouthend chamber containing an aerosol forming agent. The fuel rod preferably was a molding or extrusion of reconstituted tobacco and/or tobacco substitute, although the patent also proposed the use of tobacco, a mixture of tobacco substitute material and carbon, or a sodium carboxymethylcellulose (SCMC) and carbon mixture. The aerosol forming agent was proposed to be a nicotine source material, or granules or microcapsules of a flavorant in triacetin or benzyl benzoate. Upon burning, air entered the air passage where it was mixed with combustion gases from the burning fuel rod. The flow of these hot gases reportedly ruptured the granules or microcapsules to release the volatile material. This material reportedly formed an aerosol and/or was transferred into the mainstream aerosol. It is believed that the articles of Bolt et al., due in part to the long fuel rod, would produce insufficient aerosol from the aerosol former to be acceptable, especially in the early puffs. The use of microcapsules or granules would further impair aerosol delivery because of the heat needed to rupture the wall material. Moreover, total aerosol delivery would appear dependent on the use of a large mass of tobacco or tobacco substitute materials, which would provide substantial pyrolysis products and sidestream smoke which would not be desirable in this type smoking article.

U.S. Pat. No. 3,516,417 to Moses proposed a smoking article, with a tobacco fuel, which was identical to the article of Bolt et al., except that Moses used a double density plug of tobacco in lieu of the granular or microencapsulated flavorant of Bolt et al. See FIG. 4, and col. 4, lines 17–35. Similar tobacco-based fuel articles are described in U.S. Pat. No. 4,347,855 to Lanzilotti et al. and in U.S. Pat. No. 4,391,285 to Burnett et al. European Patent Application Publication No. 117,355, by Hearn et al., describes similar smoking articles having a pyrolyzed ligno-cellulosic heat source with an axial passageway therein. These articles would suffer many of the same problems as the articles proposed by Bolt et al.

Steiner, in U.S. Pat. No. 4,474,191, describes "smoking devices" containing an air-intake channel which, except during the lighting of the device, is completely isolated from the combustion chamber by a fire resistant wall. To assist in the lighting of the device, Steiner provides means for allowing the brief, temporary passage of air between the combustion chamber and the air-intake channel. Steiner's heat conductive wall also serves as a deposition area for nicotine and other volatile or sublimable tobacco simulating substances. In one embodiment (FIGS. 9 and 10), the device is provided with a hard, heat transmitting envelope. Materials reported to be useful for this envelope include ceramics, graphite, metals, etc. In another embodiment, Steiner envisions the replacement of his tobacco (or other combustible, material) fuel source with some purified cellulose based product in an open cell configuration, mixed with activated charcoal. This material, when impregnated with an aromatic substance, is stated to dispense a smoke-free, tobacco-like aroma.

Despite decades of interest and effort, there is still no smoking article on the market which provides the benefits and advantages associated with conventional cigarette smoking, without delivering considerable quantities of incomplete combustion and pyrolysis products.

SUMMARY OF THE INVENTION

The invention comprises a smoking article, preferably in cigarette form, which utilizes a combustible carbonaceous fuel element, generally less than about 30 mm in length, in conjunction with a physically separate aerosol generating means which includes one or more aerosol forming materials. Preferably, the aerosol generating means is in a conductive heat exchange relationship with the fuel element and/or at least a portion of the fuel element is circumscribed by a resilient insulating jacket to reduce radial heat loss. Upon lighting, the fuel element generates heat which is used to volatilize the aerosol forming materials in the aerosol generating means. These volatile materials are then drawn toward the mouth end, especially during puffing, and into the user's mouth, akin to the smoke of a conventional cigarette.

Smoking articles of the present invention are capable of producing substantial quantities of aerosol, both initially and over the useful life of the product, and are capable of providing the user with the sensations and benefits of cigarette smoking, without the necessity of burning tobacco. The aerosol produced by the aerosol generating means is produced without significant thermal degradation and is delivered to the user without the presence of substantial pyrolysis or incomplete combustion products, and preferably without substantial quantities of visible sidestream smoke. Preferably, the aerosol delivered to the user has no significant mutagenic activity as measured by the Ames test discussed hereinafter.

Preferably, the carbonaceous fuel element utilized in the invention is less than about 20 mm in length, more preferably less than about 15 mm in length, from about 3 to 7 mm in diameter, and has a density of at least about 0.5 g/cc, more preferably of at least about 0.7 g/cc, as measured, e.g., by mercury displacement. Preferred carbonaceous fuel elements are molded or extruded from combustible carbon and a binder such as sodium carboxymethylcellulose (SCMC). The carbonaceous fuel elements preferably used in practicing the invention are particularly advantageous because they produce minimal pyrolysis and incomplete combustion products, produce little or no visible sidestream smoke, and minimal ash, and have a high heat capacity. A relatively high density fuel material normally is used to help insure that the small fuel element will burn long enough to simulate the burning time of a conventional cigarette and that it will provide sufficient energy to generate the desired amounts of aerosol.

Preferred carbonaceous fuel elements are normally provided with one or more longitudinal passageways, more preferably from 5 to 9 passageways or more, which help to control the transfer of heat from the burning fuel element to the aerosol forming materials in the aerosol generating means. Preferred passageway designs also help to improve ease of lighting, the overall and/or per puff aerosol delivery, flavor delivery, and/or the amount of carbon monoxide delivered by the article.

Advantageously, the aerosol generating means includes a substrate or carrier, preferably a heat stable material, bearing one or more aerosol forming materials. Preferably, the conductive heat exchange relationship between the fuel and the aerosol generator is achieved by providing a heat conducting member, such as a metal conductor, which contacts the fuel element and the aerosol generating means and efficiently conducts or transfers heat from the burning fuel element to the aerosol generating means. This heat conducting member preferably contacts the fuel element and the aerosol generating means around at least a portion of their peripheral surfaces and preferably is recessed or spaced from the lighting end of the fuel element, advantageously by at least about 3 mm, preferably by at least about 5 mm, to avoid interference with lighting and burning of the fuel and to avoid any protrusion of the heat conducting member. More preferably, the heat conducting member also encloses at least a part of the substrate for the aerosol forming materials. Alternatively, a separate conductive container may be provided to enclose the aerosol forming materials.

In addition, at least a part of the fuel element is preferably provided with a peripheral insulating member, such as a jacket of insulating fibers, the jacket preferably being of resilient, nonburning material at least 0.5 mm thick. This member reduces radial heat loss and assists in retaining and directing heat from the fuel element toward the aerosol generating means and in reducing the potential fire-causing propensity of the fuel. The preferred insulating member overwraps or circumscribes at least part of the fuel element, and advantageously at least part of the aerosol generating means, which helps simulate the feel of a conventional cigarette. The materials used to insulate the fuel element and the aerosol generating means may be the same or different.

Because the preferred fuel element is relatively short, the hot, burning fire cone is always close to the aerosol generating means, which maximizes heat transfer thereto and the resultant production of aerosol, especially in embodiments which are provided with a multiple passageway fuel element, a heat conducting member, and/or an insulating member. Because the aerosol forming substance is physically separate from the fuel element, it is exposed to substantially lower temperatures than are present in the burning fire cone, thereby minimizing the possibility of thermal degradation of the aerosol former.

The smoking article of the present invention normally is provided with a mouthend piece including means, such as a longitudinal passage, for delivering the volatile material produced by the aerosol generating means to the user. Preferably, the mouthend piece includes a resilient outer member, such as an annular section of cellulose acetate tow, to help simulate the feel of a conventional cigarette. Advantageously, the article has the same overall dimensions as a conventional cigarette, and as a result, the mouthend piece and the aerosol delivery means usually extend over about one-half or more of the length of the article. Alternatively, the fuel element and the aerosol generating means may be produced without a built-in mouthend piece or aerosol delivery means, for use with a separate, disposable or reusable mouthend piece.

The smoking article of the present invention also may include a charge or plug of tobacco which may be used to add a tobacco flavor to the aerosol. This tobacco charge may be placed between the aerosol generating means and the mouth end of the article. Preferably, an annular section of tobacco is placed around the periphery of the aerosol generating means where it also acts as an insulating member and helps simulate the aroma and feel of a conventional cigarette. A tobacco charge also may be mixed with, or used as, the substrate for the aerosol forming material. Other substances, such as flavoring agents, also may be incorporated into the article to flavor or otherwise modify the aerosol delivered to the user. Tobacco, a tobacco extract flavor, or other material also may be incorporated in the fuel element to provide additional flavor, especially on early puffs, preferably without affecting the Ames test activity of the article.

Preferred embodiments of the invention are capable of delivering at least 0.6 mg of aerosol, measured as wet total particulate matter (WTPM), in the first 3 puffs, when smoked under FTC smoking conditions. (FTC smoking conditions consist of two seconds of puffing (35 ml total volume) separated by 58 seconds of smolder.) More preferred embodiments of the invention are capable of delivering 1.5 mg or more of aerosol in the first 3 puffs. Most preferably, embodiments of the invention are capable of delivering 3 mg or more of aerosol in the first 3 puffs when smoked under FTC smoking conditions. Moreover, preferred embodiments of the invention deliver an average of at least about 0.8 mg of wet total particulate matter per puff for at least about 6 puffs, preferably for at least about 10 puffs, under FTC smoking conditions.

The smoking article of the present invention also is capable of providing an aerosol which is chemically simple, consisting essentially of air, oxides of carbon, water, the aerosol former, any desired flavorants or other desired volatile materials, and trace amounts of other materials. This aerosol preferably has no significant mutagenic activity according to the Ames test, Ames et al., *Mut. Res.*, 31:347–364 (1975); Nagao et al., *Mut. Res.*, 42:335 (1977).

In addition, the article may be made virtually ashless so that the user does not have to remove any ash during use. It also may be designed to produce little or no visible sidestream smoke.

As used herein, and only for the purposes of this application, "aerosol" is defined to include vapors, gases, particles, and the like, both visible and invisible, and especially those components perceived by the user to be "smoke-like," generated by action of the heat from the burning fuel element upon substances contained within the aerosol generating means, or elsewhere in the article. As so defined, the term "aerosol" also includes volatile flavoring agents and/or pharmacologically or physiologically active agents, irrespective of whether they produce a visible aerosol.

As used herein, the term "conductive heat exchange relationship" is defined as a physical arrangement of the aerosol generating means and the fuel element whereby heat is transferred by conduction from the burning fuel element to the aerosol generating means substantially throughout the burning period of the fuel element. Conductive heat exchange relationships can be achieved by locating the aerosol generating means in contact with the fuel element and in close proximity to the burning portion of the fuel element, and/or by utilizing a conductive member to transfer heat from the burning fuel to the aerosol generating means. Preferably both methods of providing conductive heat transfer are used.

As used herein, the term "carbonaceous" means primarily comprising carbon.

As used herein, the term "insulating member" applies to all materials which act primarily as insulators. Preferably, these materials do not burn during use, but they may include slow burning carbons and like materials, and especially materials which fuse during use, such as low temperature grades of glass fibers. Suitable insulators have a thermal conductivity in g-cal/(sec)($cm^2$)(°C./cm), of less than about 0.05, preferably less than about 0.02, most preferably less than about 0.005. See, *Hackh's Chemical Dictionary,* 672 (4th ed., 1969) and *Lange's Handbook of Chemistry,* 10, 272–274 (11th ed., 1973).

The smoking article of the present invention is described in greater detail in the accompanying drawings and in the detailed description of the invention which follow.

DETAILED DESCRIPTION OF THE INVENTION

Figure 1:
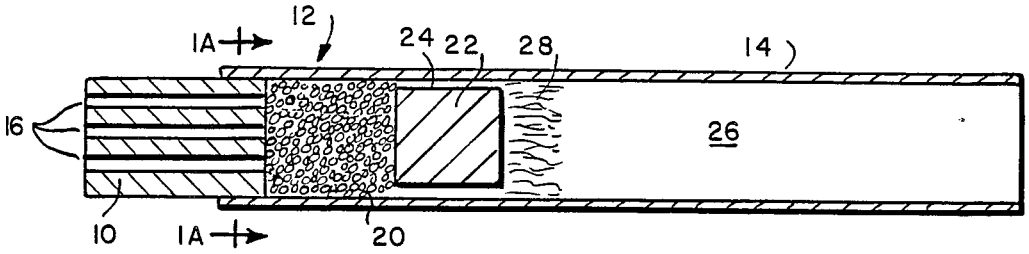
FIGS. 1 through 12 are longitudinal sectional views of various embodiments of the invention.
Figure 1A:
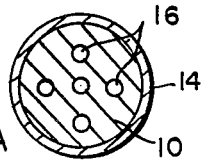
FIG. 1A is a sectional view of the embodiment of FIG. 1, taken along lines 1A—1A in FIG. 1.

The embodiment of the invention illustrated in FIG. 1, which preferably has the overall dimensions of a conventional cigarette, includes a short, about 20 to 25 mm long, combustible carbonaceous fuel element 10, an abutting aerosol generating means 12, and a foil lined paper tube 14, which forms the mouthend 15 of the article. In this embodiment, fuel element 10 is a "blowpipe" charcoal, i.e., a carbonized wood, which is provided with five longitudinally extending holes 16. See FIG. 1A. The fuel element 10 optionally may be wrapped with cigarette paper to improve lighting of the charcoal fuel. This paper may be treated with known burn additives.

Aerosol generating means 12 includes a plurality of glass beads 20 coated with an aerosol forming material or materials, such as glycerin. The glass beads are held in place by a porous disc 22, which may be made of cellulose acetate. This disc may be provided with a series of peripheral grooves 24 which provide passages between the disc and the foil lined tube 14.

The foil lined paper tube 14, which forms the mouthend piece of the article, circumscribes aerosol generating means 12 and about 5 mm of the rear, non-lighting end of fuel element 10 so that the foil lined tube is spaced about 15 to 20 mm from the lighting end. The tube also forms an aerosol delivery passage 26 between the aerosol generating means 12 and mouth end 15 of the article. The presence of foil lined tube 14, which couples the nonlighting end of fuel 10 to aerosol generator 12, also increases heat transfer to the aerosol generator. The foil also helps to extinguish the fire cone. When only a small amount of the unburned fuel remains, heat loss through the foil acts as a heat sink which helps to extinguish the fire cone. The foil used in this article is typically an aluminum foil of 0.35 mils (0.0089 mm) in thickness, but the thickness and/or the type of conductor employed may be varied to achieve virtually any desired degree of heat transfer.

The article illustrated in FIG. 1 also includes an optional mass or plug of tobacco 28 to contribute flavor to the aerosol. This tobacco charge 28 may be placed at the mouth end of disc 22, as shown in FIG. 1, or it may be placed between glass beads 20 and disc 22. It also may be placed in passage 26 at a location spaced from aerosol generator 12.

Figure 2:
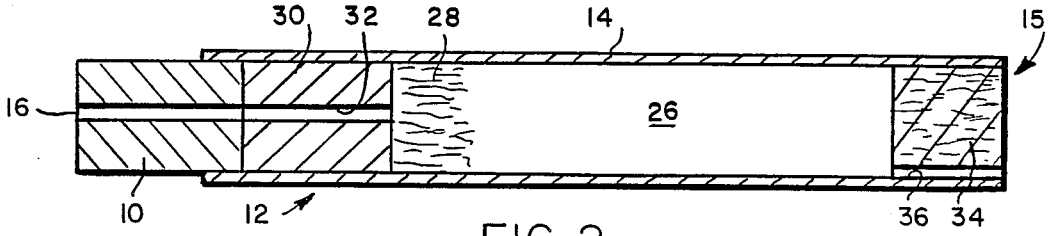
Figure 2A:
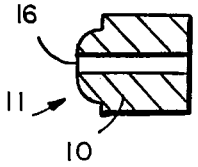
FIG. 2A is a longitudinal sectional view of a modified, tapered fuel element useful in the embodiment of FIG. 2.

In the embodiment shown in FIG. 2, the short fuel element 10 is a pressed carbon rod or plug, about 10 to 20 mm long, which is provided with an axial hole 16. Alternatively, the fuel may be formed from carbonized fibers and preferably also provided with an axial passageway corresponding to hole 16. About 2 to 3 mm of the fuel element is inserted into the foil lined tube 14, so that the tube is spaced about 7 to 18 mm from the lighting end. In this embodiment, aerosol generating means 12 includes a thermally stable conductive carbonaceous substrate 30, such as a plug of porous carbon, which is impregnated with an aerosol forming material and materials. This substrate may be provided with an optional axial passageway 32, as is shown in FIG. 2. This embodiment also includes a mass of tobacco 28 which is preferably placed at the mouth end of substrate 30. For appearance sake, this article also includes an optional low efficiency cellulose acetate filter 34, which may be provided with peripheral grooves 36 to provide passages for the aerosol forming materials between filter 34 and foil tube 14. Optionally, as shown in FIG. 2A, the lighting end 11 of the fuel element may be tapered to improve lightability.

Figure 3:
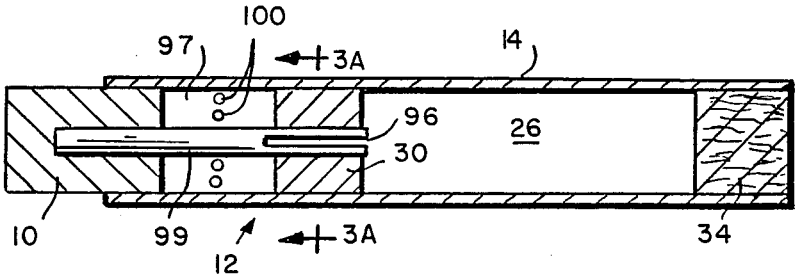

The embodiment of the invention illustrated in FIG. 3 includes a short combustible carbonaceous fuel element 10, about 20 mm long, connected to aerosol generating means 12 by a heat conductive rod 99 and by a foil lined paper tube 14, which also leads to the mouth end 15 of the article. In this embodiment, fuel element 10 may be blowpipe charcoal or a pressed or extruded carbon rod or plug or other carbonaceous fuel source.

Aerosol generating means 12 includes a thermally stable carbonaceous substrate 30, such as a plug of porous carbon, which is impregnated with one or more aerosol forming materials. This embodiment includes a void space 97 between the fuel element 10 and the substrate 30. The portion of the foil lined tube 14 surrounding this void space includes a plurality of peripheral holes 100 which permit sufficient air to enter the void space to provide appropriate pressure drop.

Figure 3A:
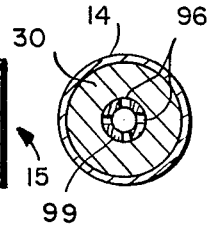
FIG. 3A is a sectional view of the embodiment of FIG. 3, taken along lines 3A—3A in FIG. 3.

As shown in FIGS. 3 and 3A, the heat conducting means includes the conductive rod 99 and the foil lined tube 14, both of which are spaced from the lighting end of the fuel element. The rod 99 is spaced about 5 mm from the lighting end; the tube about 15 mm. The rod 99 is preferably formed of aluminum and has at least one, preferably from 2 to 5, peripheral grooves 96 therein, to allow air passage through the substrate. The article of FIG. 3 has the advantage that the air introduced into void space 97 contains less oxidation products because it is not drawn through the burning fuel.

Figure 4:
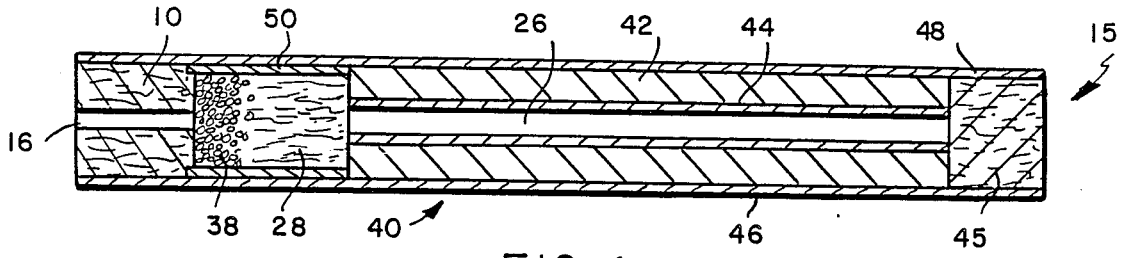

The embodiment illustrated in FIG. 4 includes a fibrous carbon fuel element 10, such as carbonized cotton or rayon, about 10 to 15 mm in length. The fuel element includes a single axial hole 16. The substrate 38 of the aerosol generator is a granular, thermally stable carbon or alumina impregnated with an aerosol forming material. A mass of tobacco 28 is located immediately behind the substrate. This article is provided with a cellulose acetate tube 40, in place of the foil lined tube of previous embodiments. This tube 40 includes an annular section 42 of resilient cellulose acetate tow surrounding an optional plastic tube 44 of polypropylene, Nomex, Mylar, or the like. At the mouth end 15 of this element there is a low efficiency cellulose acetate filter plug 45.

The entire length of the article may be wrapped in cigarette-type paper 46. A cork or white ink coating 48 may be used on the mouth end to simulate tipping. A foil strip 50 is located on the inside of the paper, toward the fuel end of the article. This strip preferably overlaps the rear 2 to 3 mm of the fuel element and extends to the mouth end of the tobacco charge 28. It may be integral with the paper or it may be a separate piece applied before the paper overwrap.

Figure 5:
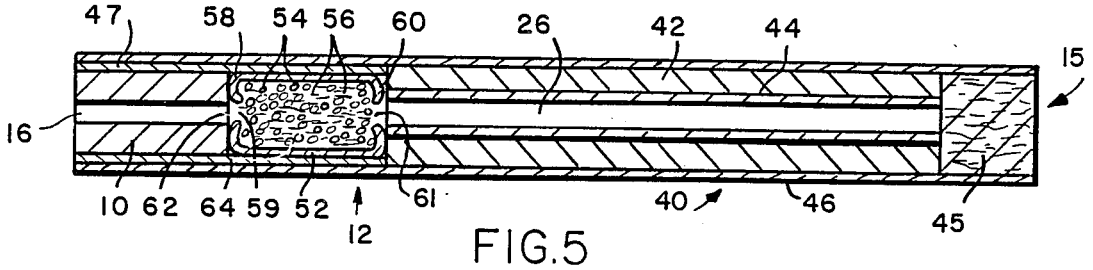

The embodiment of FIG. 5 is similar to that of FIG. 4. In this embodiment, the aerosol generating means 12 is formed by an aluminum capsule 52 which is filled with a granular substrate or, as shown in the drawing, a mixture of a granular substrate 54 and tobacco 56. The capsule 52 is crimped at its ends 58, 60 to enclose the material and to inhibit migration of the aerosol former. The crimped end 58, at the fuel end, preferably abuts the rear end of the fuel element to provide for conductive heat transfer.

A void space 62 formed by end 58 also helps to inhibit migration of the aerosol former to the fuel. Longitudinal passageways 59 and 61 are provided to permit the passage of air and the aerosol forming material. Capsule 52 and fuel element 10 may be united by a conventional cigarette paper 47, as illustrated in the drawing, by a perforated ceramic paper, or a metallic strip or tube. If cigarette paper is used, a strip 64 near the rear end of the fuel should be printed or treated with sodium silicate or other known materials which cause the paper to extinguish. If a metal foil is used, it preferably should be spaced about 7 to 12 mm from the lighting end of the fuel. The entire length of the article may be overwrapped with conventional cigarette paper 46.

Figure 6:
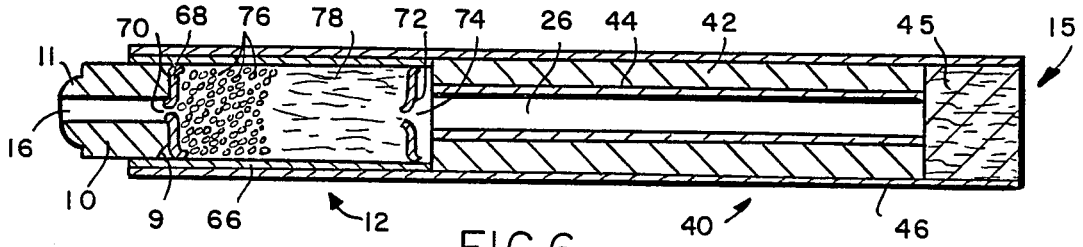

FIG. 6 illustrates another embodiment having a pressed carbon fuel element 10, about 7 to 10 mm long. In this embodiment, the fuel element has a tapered lighting end 11 for easier lighting and a tapered rear end 9 for easy fitting into a tubular foil wrapper 66. Abutting the rear end of the fuel element is an aluminum disc 68 with a center hole 70. A second, optional aluminum disc 72 with hole 74 is located at the mouth end of the aerosol generator 12. In between is a zone 76 of a particulate substrate and a zone 78 of tobacco. The foil wrapper 66, in which the rear 2 to 3 mm of the fuel element is mounted, extends back beyond the second aluminum disc 72. This embodiment also includes a hollow cellulose acetate rod 42 with an internal polypropylene tube 44, and a low efficiency cellulose acetate filter plug 45. The entire length of the article is preferably wrapped with cigarette paper 46.

Figure 7:
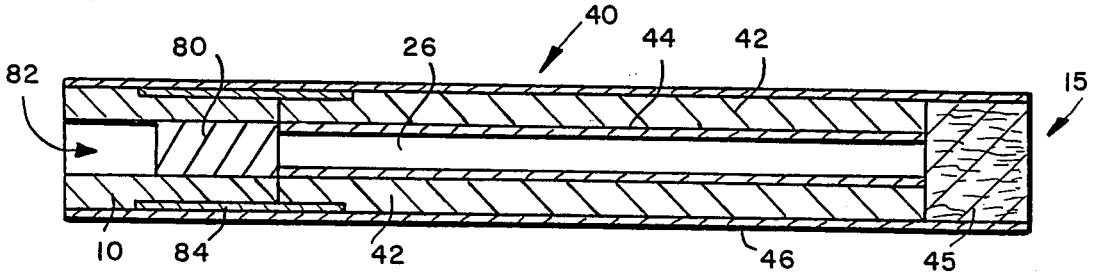

The embodiment shown in FIG. 7 illustrates the use of a substrate 80 impregnated with one or more aerosol forming materials which is embedded within a large cavity 82 in fuel element 10. In this type of embodiment, the fuel element preferably is formed from an extruded carbon, and the substrate 80 usually is a relatively rigid, porous material. The entire length of the article may be wrapped with conventional cigarette paper 46. This embodiment may also include a foil strip 84 to couple fuel element 10 to the cellulose acetate tube 40 and to help extinguish the fuel. This strip may be spaced about 5 to 10 mm or more from the lighting end, depending on the length of the fuel element.

The embodiments shown in FIGS. 8 through 11 include a resilient insulating jacket which encircles or circumscribes the fuel element to insulate and help concentrate the heat in the fuel element. These embodiments also help to reduce any fire causing potential of the burning fire cone and, in some cases, help simulate the feel of a conventional cigarette.

Figure 8:
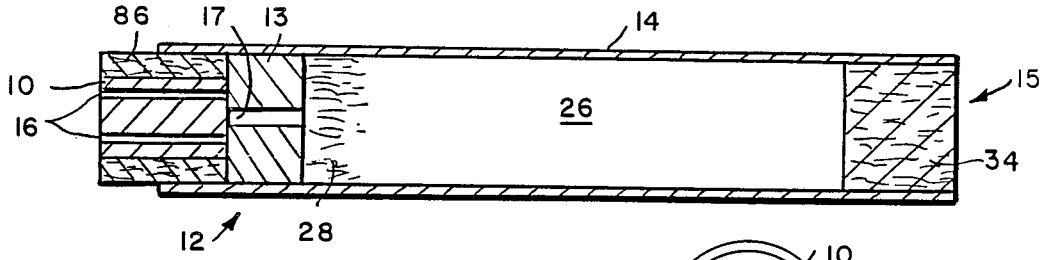
Figure 8A:
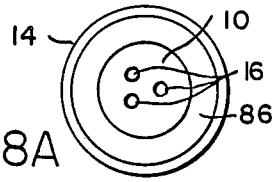
FIGS. 8A, 9A, 9B, 10A, 10B, 10C, 11A, and 12A are end views showing various fuel element passageway configurations suitable for use in embodiments of the invention.

In the embodiment of FIG. 8, the fuel element 10 is provided with a plurality of holes 16 and is surrounded by a resilient jacket 86 about 0.5 mm thick, as shown in FIG. 8A. This jacket is formed of insulating fibers, such as ceramic (e.g., glass) fibers or nonburning carbon or graphite fibers. The arrangement of holes also is shown in FIG. 8A. The aerosol generating means 12 comprises a porous carbon mass 13 having a single axial hole 17.

Figure 9:
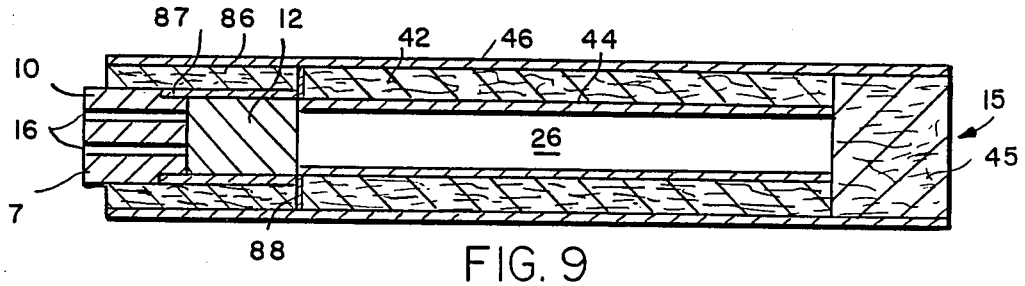

In the embodiment shown in FIG. 9, the resilient insulating jacket 86, preferably of glass fibers, surrounds the periphery of both a pressure formed carbonaceous fuel element 10 and a porous carbon mass aerosol generating means 12. In this embodiment, fuel element 10 has three equally sized passageways 16, such as those illustrated in FIGS. 9A and 9B, and the lighting end 7 of fuel element 10 extends slightly beyond the fiber jacket 86 for ease of lighting. Carbon mass 12 and the rear portion of the fuel element 10 are surrounded by a piece of aluminum foil 87 to conduct heat from the fuel element to carbon mass 12 and to help extinguish the fire cone when the fuel element burns back to the point of contact with conductor 87. A layer of glue 88 is applied at the forward end of the annular section of cellulose acetate tow 42 to seal the end of the tow and block air therethrough.

Figure 10:
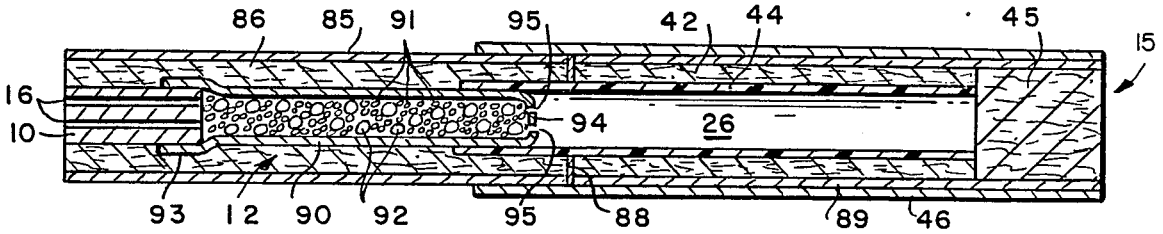
Figure 10A:
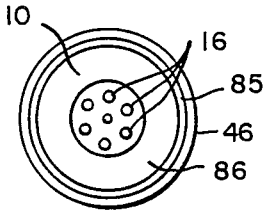
Figure 10B:
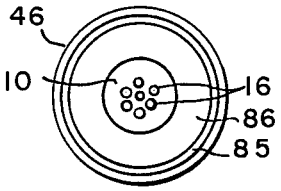
Figure 10C:
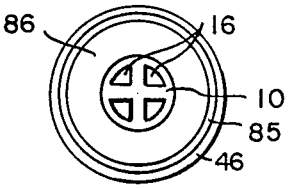

In the embodiment of FIG. 10, the resilient insulating jacket 86 surrounds the periphery of both fuel element 10 and aerosol generating means 12 and is preferably a low temperature material which fuses during use. This jacket 86 is overwrapped with a nonporous paper 85, such as P 878-5 obtained from Kimberly-Clark. In this embodiment, the fuel element is about 8 to 12 mm, preferably about 10 mm, long and is preferably provided with three or more passageways 16 to increase air flow through the fuel. Three suitable passageway arrangements are illustrated in FIGS. 10A, 10B, and 10C.

In this embodiment, the aerosol generating means 12 comprises a metallic container 90 which encloses a granular substrate 91 and/or densified tobacco 92, one or both of which include an aerosol forming material. As illustrated, the open end 93 of container 90 overlaps the rear 2 to 4 mm portion of fuel element 10. Alternatively, the open end 93 may abut the rear end of fuel element 10. The opposite end of container 90 is crimped to form wall 94, which is provided with a plurality of passages 95 to permit passage of gases, tobacco flavors, and/or the aerosol forming material into aerosol delivery passage 26.

Plastic tube 44 abuts or preferably overlaps walled end 94 of metallic container 90 and is surrounded by a section of resilient, high density cellulose acetate tow 42. A layer of glue 88, or other material, may be applied to the fuel end of tow 42 to seal the tow and block air flow therethrough. A low efficiency filter piece 45 is provided at the mouth end of the article, and tow 42 and filter piece 45 are preferably overwrapped with a conventional plug wrap paper 89. Another layer of cigarette paper 46 may be used to join the rear portion of the insulating jacket 86 and the tow/filter section.

In a modified version of the embodiment of FIG. 10, the insulating jacket may also be used in lieu of the cellulose acetate tow 42, so that the insulating jacket extends from the lighting end to the filter piece 45. In embodiments of this type, a layer of glue is preferably applied to the annular section of the filter piece which abuts the end of the insulating jacket, or a short annular section of tow is placed between the insulating jacket and the filter piece, with glue applied at either end.

Figure 11:
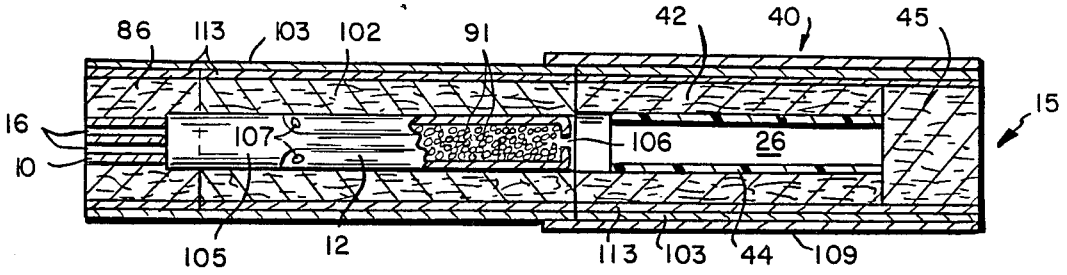
Figure 11A:
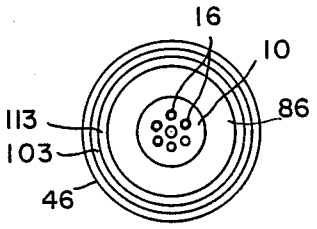
Figure 11B:
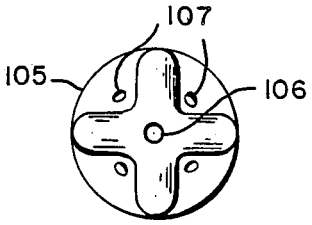
FIG. 11B is an enlarged end view of the metallic container employed in the embodiment of FIG. 11.

FIG. 11 illustrates an embodiment in which fuel element 10, preferably about 10 mm long, is overwrapped with an insulating jacket 86 of glass fibers and the aerosol generating means is circumscribed by a jacket of tobacco 102. The glass fibers used in this embodiment preferably have a softening temperature below about 650° C., such as experimental fibers 6432 and 6437 obtained from Owens-Corning, Toledo, Ohio, so that they will fuse during use. The glass fiber and tobacco jackets are each overwrapped with a plug wrap paper 113, such as Ecusta 646, and are joined by an overwrap of cigarette paper 103, such as 780-63-5 or P 878-16-2, obtained from Kimberly-Clark. In this embodiment, the metallic capsule 105 preferably overlaps the rear 2 to 4 mm of the fuel element so that it is spaced about 6 to 8 mm from the lighting end, and the rear portion of the metallic capsule 105 is crimped into a lobe shape, as shown in FIG. 11B. A passage 106 is provided at the mouth end of the capsule, in the center of the capsule. Four additional passages 107 are provided at the transition points between the crimped and uncrimped portion of the capsule. Alternatively, the rear portion of the capsule may have a rectangular or square cross section in lieu of the lobes, or a simple tubular capsule with a crimped, mouth end may be employed, with or without peripheral passages 107.

At the mouth end of tobacco jacket 102 is a mouthend piece 40 including an annular section of cellulose acetate tow 42, a plastic inner tube 44, a low efficiency filter piece 45, and layers of cigarette paper 103 and 113. The mouth end piece 40 is joined to the jacketed fuel/capsule end by an overwrapping layer of tipping paper 109. As illustrated, the capsule end of plastic tube 44 is spaced from the capsule 105. Thus, the hot vapors flowing through passages 107 pass through tobacco jacket 102, where volatile components in the tobacco are vaporized or extracted, and then into passage 26 where the tobacco jacket abuts the cellulose acetate tow 42.

In embodiments of this type having low density fuel insulating jackets 86, some air and gases pass through jacket 86 and into tobacco jacket 102. Thus, the peripheral passages 107 in capsule 105 may not be needed to extract tobacco flavor from the tobacco jacket 102.

Figure 12:
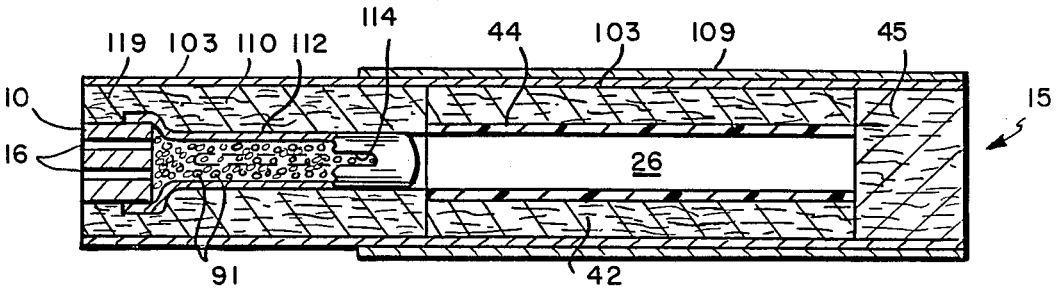

In the embodiment of FIG. 12, the jacket 110 comprises tobacco or an admixture of tobacco and insulating fibers, such as glass fibers. As shown, the tobacco jacket 110 extends just beyond the mouth end of metallic container 112. Alternatively, it may extend over the entire length of the article, up to the mouth end filter piece. In embodiments of this type, container 112 is preferably enlarged at the fuel end and is spaced about 4 to 8 mm from the lighting end. It also is preferably provided with one or more longitudinal slots 114 on its periphery (preferably two slots 180° apart) so that vapors from the aerosol generator pass through the annular section of tobacco which surrounds the aerosol generator to extract tobacco flavor before entering passage 26.

As illustrated, the tobacco 119 at the fuel element end of jacket 110 is compressed. This aids in reducing air flow through the tobacco, thereby reducing the burn potential thereof. In addition, the container 112 aids in extinguishing the tobacco by acting as a heat sink. This heat sink effect helps quench any burning of the tobacco encircling the capsule, and it also, helps to evenly distribute heat to the tobacco encircling the aerosol generating means, thereby aiding in the release of tobacco flavor components. In addition, it may be desirable to treat the portion of the cigarette paper overwrap 103 near the rear end of the fuel with a material, such as sodium silicate, to help extinguish the tobacco, so that it will not burn significantly beyond the exposed portion of the fuel element. Alternatively, the tobacco itself may be treated with a burn modifier to prevent burning of the tobacco which surrounds the aerosol generator.

Upon lighting any of the aforesaid embodiments, the fuel element burns, generating the heat used to volatilize the aerosol forming material or materials present in the aerosol generating means. These volatile materials are then drawn toward the mount end especially during puffing, and into the user's mouth, akin to the smoke of a conventional cigarette.

Because the preferred fuel element is relatively short, the hot, burning fire cone is always close to the aerosol generating body, which maximizes heat transfer to the aerosol generating means and any optional tobacco charges, and the resultant production of aerosol and optional tobacco flavor, especially when the preferred heat conducting member is used. Because of the small size and burning characteristics of the preferred carbonaceous fuel element, the fuel element usually begins burning over most of its length within a few puffs. Thus, the portion of the fuel element adjacent to the aerosol generating means becomes hot quickly, which significantly increases heat transfer to the aerosol generating means, especially during the early and middle puffs. Because the preferred fuel element is short, there is never a long section of nonburning fuel to act as a heat sink, as was common in previous thermal aerosol articles.

Heat transfer, and therefor aerosol delivery, also is enhanced by the use of passageways through the fuel, which draw hot air to the aerosol generator, especially during puffing. Heat transfer also is enhanced by the preferred heat conducting member, which is spaced or recessed from the lighting end of the fuel element to avoid interference with lighting and burning of the fuel and to avoid any unsightly protrusion, even after use. In addition, the preferred insulating member tends to confine, direct, and concentrate the heat toward the central core of the article, thereby increasing the heat transferred to the aerosol forming substance.

Because the aerosol forming material is physically separate from the fuel element, it is exposed to substantially lower temperatures than are present in the burning fire cone. This minimizes the possibility of thermal degradation of the aerosol former and attendant off-taste. This also results in aerosol production during puffing, but minimal aerosol production from the aerosol generating means during smolder. In addition, the use of a carbonaceous fuel element and a physically separate aerosol generating means eliminates the presence of substantial pyrolysis or incomplete combustion products and avoids the production of substantial visible sidestream smoke.

In the preferred embodiments of the invention, the short carbonaceous fuel element, the recessed heat conducting member, the insulating member, and/or the passages in the fuel cooperate with the aerosol generator to provide a system which is capable of producing substantial quantities of aerosol and optional tobacco flavor, on virtually every puff. The close proximity of the fire cone to the aerosol generator after a few puffs, together with the conducting member, the insulating member, and/or the multiple passageways in the fuel element, results in high heat delivery both during puffing and during the relatively long period of smolder between puffs.

While not wishing to be bound by theory, it is believed that the aerosol generating means is maintained at a relatively high temperature between puffs, and that the additional heat delivered during puffing, which is significantly increased by the preferred passageways in the fuel element, ie primarily utilized to vaporize the aerosol forming material. This increased heat transfer makes more efficient use of the available fuel energy, reduces the amount of fuel needed, and helps deliver early aerosol. Further, the conductive heat transfer utilized in the invention is believed to reduce the carbon fuel combustion temperature which, it is further believed, reduces the $CO/CO_2$ ratio in the combustion products produced by the fuel. See, e.g., G. Hagg, *General Inorganic Chemistry,* at p. 592 (John Wiley & Sons, 1969).

Furthermore, by the appropriate selection of the fuel element composition, the number, size, configuration, and arrangement of fuel element passageways, the insulating jacket, the paper overwrap, and/or the heat conducting means, it is possible to control the burn properties of the fuel source to a substantial degree. This provides significant control over the heat transferred to the aerosol generator, which in turn, can be used to alter the number of puffs and/or the amount of aerosol delivered to the user.

In general, the combustible carbonaceous fuel elements which may be employed in practicing the invention are less than about 30 mm long. Preferably the fuel element is about 20 mm or lens, more preferably from about 5 to 15 mm, and most preferably from about 8 to 12 mm, in length. Advantageously, the diameter of the fuel element is about 8 mm or less, preferably between about 3 and 7 mm, and more preferably between about 4 to 6 mm. The density of the carbonaceous fuel elements normally range from about 0.5 g/cc to about 1.5 g/cc, as measured, e.g., by mercury displacement. Preferably, the density is greater than 0.7 g/cc., more preferably greater than 0.8 g/cc, In most cases, a high density material is desired because it helps to ensure that the fuel element will burn long enough to simulate the burning time of a conventional cigarette and that it will provide sufficient energy to generate the required amount of aerosol. Carbonaceous fuel elements having these characteristics are sufficient to provide fuel for at least about 7 to 10 puffs, the normal number of puffs generally obtained by smoking a conventional cigarette under FTC conditions.

Preferably, the carbon content of the fuel element is at least about 60 to 70%, most preferably at least about 80%, or more, by weight. High carbon content fuels are preferred because they produce minimal pyrolysis and incomplete combustion products, little or no visible sidestream smoke, and minimal ash, and have a high heat capacity. However, lower carbon content fuel elements, e.g., about 50 to 65 weight percent carbon, are within the scope of this invention, especially where a minor amount of tobacco, tobacco extract, or a non-burning inert filler is used.

The carbonaceous materials used in or as the preferred fuel may be derived from virtually any of the numerous carbon sources known to those skilled in the art. Preferably, the carbonaceous material is obtained by the pyrolysis or carbonization of cellulosic materials, such as wood, cotton, rayon, tobacco, coconut, paper, and the like, although carbonaceous materials from other sources may be used.

In most instances, the carbonaceous fuel element should be capable of being ignited by a conventional cigarette lighter without the use of an oxidizing agent. Burning characteristics of this type may generally be obtained from a cellulosic material which has been pyrolyzed at temperatures between about 400° C. to about 1000° C., preferably between about 500° C. to about 950° C., more preferably between about 650° C. to 750° C., in an inert atmosphere, or under a vacuum. The pyrolysis time is not believed to be critical, as long as the temperature at the center of the pyrolyzed mass has reached the aforesaid temperature range for at least a few minutes, e.g., about 15 minutes. A slow pyrolysis, employing gradually increasing temperatures over many hours is believed to produce a more uniform material with a higher carbon yield. Preferably, the pyrolyzed material is then cooled, ground to a fine powder, and heated in an inert gas stream at a temperature between about 650° C. to 750° C. to remove volatiles prior to further processing.

While undesirable in most cases, carbonaceous fuel elements which require the addition of an oxidizing agent to render them ignitable by a cigarette lighter are within the scope of this invention, as are carbonaceous materials which require the use of a glow retardant or other type of combustion modifying agent. Such combustion modifying agents are disclosed in many patents and publications and are known to those of ordinary skill in the art.

In certain preferred embodiments, the carbonaceous fuel elements are substantially free of volatile organic material. By that, it is meant that the fuel element is not purposely impregnated or mixed with substantial amounts of volatile organic materials, such as volatile aerosol forming or flavoring agents, which could degrade in the burning fuel. However, small amounts of water, which are naturally adsorbed by the fuel, may be present therein. Similarly, small amounts of the aerosol forming materials may migrate from the aerosol generating means and thus may also be present in the fuel element.

In other preferred embodiments, the carbonaceous fuel element may contain tobacco, tobacco extracts, and/or other materials, primarily to add flavor to the aerosol. Amounts of these additives may range up to about 25 weight percent or more, depending upon the additive, the fuel element, and the desired burning characteristics. Tobacco and/or tobacco extracts may be added to carbonaceous fuel elements, e.g., up to at least about 10 to 20 weight percent, thereby providing tobacco flavors to the mainstream and a tobacco aroma to the sidestream akin to a conventional cigarette, without affecting the Ames test activity of the article.

A preferred carbonaceous fuel element is a molded, pressed, or extruded carbon mass prepared from carbon and a binder, by conventional molding or extrusion techniques. A preferred activated carbon for such a fuel element is PCB-G, and a preferred non-activated carbon is PXC, both available from Calgon Carbon Corporation, Pittsburgh, Pa. Other preferred carbons for pressure forming and/or extrusion are prepared from pyrolyzed cotton or pyrolyzed papers, such as Grande Prairie Canadian Kraft, available from the Buckeye Cellulose Corporation of Memphis, Tenn.

The binders which may be used in preparing such a fuel element are well known in the art. A preferred binder is sodium carboxymethylcellulose (SCMC), which may be used alone, which is preferred, or in conjunction with materials such as sodium chloride, vermiculite, bentonite, calcium carbonate, and the like. Other useful binders include gums, such as guar gum, and other cellulose derivatives, such as methylcellulose and carboxymethylcellulose (CMC).

A wide range of binder concentrations can be utilized. Preferably, the amount of binder is limited to minimize contribution of the binder to undesirable combustion products. On the other hand, sufficient binder must be included to hold the fuel element together during manufacture and use. The amount used will thus depend on the cohesiveness of the carbon in the fuel element.

In general, an extruded carbonaceous fuel may be prepared by admixing from about 50 to 99 weight percent, preferably about 80 to 95 weight percent, of the carbonaceous material, with from 1 to 50 weight percent, preferably about 5 to 20 weight percent of the binder, with sufficient water to make a paste having a stiff dough-like consistency. Minor amounts, e.g., up to about 35 weight percent, preferably about 10 to 20 weight percent, of tobacco, tobacco extract, or the like, may be added to the paste with additional water, if necessary, to maintain a stiff dough consistency. The dough is then extruded using a standard ram or piston type extruder into the desired shape, with the desired passageways, and dried, preferably at about 95° C. to reduce the moisture content to about 2 to 7 percent by weight. Alternatively, or additionally, the passageways and/or cavity may be formed using conventional drilling techniques. If desired, the lighting end of the fuel elements may be tapered or reduced in diameter by machining, molding, or the like, to improve lightability.

A high quality fuel element also may be formed by casting a thin slurry of the carbon/binder mixture (with or without additional components) into a sheet, drying the sheet, regrinding the dried sheet into a powder, forming a stiff paste with water, and extruding the paste as described above.

If desired, the aforesaid fuel elements (without tobacco or tobacco extract) may be pyrolyzed after formation, for example, to about 650° C. for two hours, to convert the binder to carbon thereby forming a virtually 100% carbon fuel element.

The fuel elements employed in the present invention also may contain one or more additives to improve burning, such as up to about 5 weight percent sodium chloride to improve smoldering characteristics and as a glow retardant. Also, up to about 5, preferably 1 to 2, weight percent of potassium carbonate may be included to improve lightability. Additives to improve physical characteristics, such as clays like kaolins, serpentines, attapulgites, and the like also may be used.

Another suitable carbonaceous fuel element is a carbon fiber fuel, which may be prepared by carbonizing a fibrous precursor, such as cotton, rayon, paper, polyacrylonitile, and the like. Generally, pyrolysis at from about 650° C. to 1000° C., preferably at about 950° C., for about 30 minutes, in an inert atmosphere or vacuum, is sufficient to produce a suitable carbon fiber with good burning characteristics. Combustion modifying additives also may be added to these fibrous fuels.

Preferably, the carbonaceous fuel element is provided with one or more longitudinally extending passageways. These passageways help to control transfer of heat from the fuel element to the aerosol generating means, which is important both in terms of transferring enough heat to produce sufficient aerosol and in terms of avoiding the transfer of so much heat that the aerosol former is degraded. Generally, these passageways provide porosity and increase early heat transfer to the substrate by increasing the amount of hot gases which reach the substrate. They also tend to increase the rate of burning.

Generally, a large number of passageways, e.g., about 5 to 9 or more, especially with relatively wide spacings between the passageways, as in FIGS. 10A and 12, produce high convective heat transfer, which leads to high aerosol delivery. A large number of passageways also generally helps assure ease of lighting.

High convective heat transfer tends to produce a higher CO output in the mainstream. To reduce CO levels, fewer passageways or a higher density fuel element may be employed, but such changes generally tend to make the fuel element more difficult to ignite, and to decrease the convective heat transfer, thereby generally lowering the aerosol delivery rate and amount. However, it has been discovered that with passageway arrangements which are closely spaced, as in FIG. 10B, such that they burn out or coalesce to form one passageway, at least at the lighting end, the amount of CO in the combustion products is generally lower than in the same, but widely spaced, passageway arrangement.

The optimum arrangement, configuration, and number of fuel element passageways should deliver a steady and high supply of aerosol, allow for easy ignition, and produce low CO. Various combinations have been examined for passageway arrangement/configuration and/or number in the carbonaceous fuel elements used in various embodiments of the invention. In general, it has been discovered that fuel elements having from about 5 to 9 passageways, relatively closely spaced such that they burn away into one large passageway, at least at the lighting end of the fuel element, appear to most closely satisfy the requirements of a preferred carbonaceous fuel element for use in this invention.

Variables which affect the rate at which the fuel element passageways will coalesce upon burning include the density and composition of the fuel element, the size, shape, and number of passageways, the distance between the passageways, and the arrangement thereof. For example, for a 0.85 g/cc carbonaceous fuel source having seven passageways of about 0.5 mm diameter, the passageways should be located within a core diameter, i.e., the diameter of the smallest circle which will circumscribe the outer edge of the passageways, between about 1.6 mm and 2.5 mm in order for them to coalesce into a single passageway during burning. However, when the diameter of the seven passageways is increased to about 0.6 mm, the core diameter which will coalesce during burning increases to about 2.1 mm to about 3.0 mm.

Figure 12A:
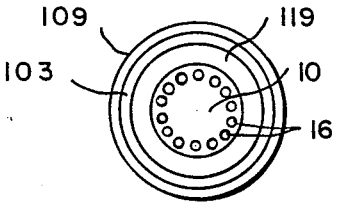
Figure 12B:
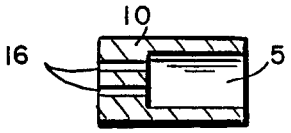
FIG. 12B is a longitudinal sectional view of a preferred fuel element passageway configuration suitable for use in embodiments of the invention.

Another preferred fuel element passageway arrangement useful in embodiments of the invention is the configuration illustrated in FIG. 12B, which has been found to be particularly advantageous for low CO delivery and ease of lighting. In this preferred arrangement, a short section at the lighting end of the fuel element is provided with a plurality of passages 16, preferably from about 5 to 9, which merge into a fuel element. In a 10 mm long, 4.5 mm diameter fuel element having closely packed passageways, for example, the cavity length would be from about 6 to 9 mm, preferably about 8 mm, and the cavity diameter would be between about 1.5 and 2 mm. In the embodiments of this type, the plurality of passages at the lighting end provide the large surface area desired for ease of lighting and early aerosol delivery. The cavity, which may be from about 30% to 95%, preferably more than 50%, of the length of the fuel element, helps assure uniform heat transfer to the aerosol generating means and tends to deliver low CO to the mainstream.

The aerosol generating means used in practicing the invention is physically separate from the fuel element. By physically separate it is meant that the substrate, container, or chamber which contains the aerosol forming materials is not mixed with, or a part of, the burning fuel element. As noted previously, this arrangement helps reduce or eliminate thermal degradation of the aerosol forming material and the presence of sidestream smoke. While not a part of the fuel, the aerosol generating means is preferably in a conductive heat exchange relationship with the fuel element, and preferably abuts or is adjacent to the fuel element. More preferably, the conductive heat exchange relationship is achieved by a heat conducting member, such as a metal tube or foil, which is preferably recessed or spaced from the lighting end of the fuel.

Preferably, the aerosol generating means includes one or more thermally stable materials which carry one or more aerosol forming materials. As used herein, a thermally stable material is one capable of withstanding the high temperatures, e.g., 400° C.–600° C., which exist near the fuel without decomposition or burning. While not preferred, other aerosol generating means, such as heat rupturable microcapsules, or solid aerosol forming substances, are within the scope of the invention, provided they are capable of releasing sufficient aerosol forming vapors to satisfactorily resemble tobacco smoke.

Thermally stable materials which may be used as a substrate or carrier for the aerosol forming materials are well known to those skilled in the art. Useful substrates should be porous and must be capable of retaining an aerosol forming material when not in use and capable of releasing a potential aerosol forming vapor upon heating by the fuel element. Substrates, especially particulates, may be placed within a container, preferably formed from a conductive material.

Useful thermally stable materials include thermally stable adsorbent carbons, such as porous grade carbons, graphite, activated, or nonactivated carbons, and the like. Other suitable materials include inorganic solids such as ceramics, glass, alumina, vermiculite, clays such as bentonite, and the like. Preferred carbon substrate materials include porous carbons such as PC225 and PG-60 available from Union Carbide, and SGL carbon available from Calgon. A preferred alumina substrate is SMR-14-1896, available from the Davidson Chemical Division of W. R. Grace & Co., which is sintered at elevated temperatures, e.g., greater than 1000° C., washed, and dried prior to use.

It has been found that suitable particulate substrates also may be formed from carbon, tobacco, or mixtures of carbon and tobacco, into densified particles in a one-step process using a machine made by Fuji Paudal KK of Japan, and sold under the trade name of "Marumerizer". This apparatus is described in German Patent No. 1,294,351 and U.S. Pat. No. 3,277,520 (now reissued as No. 27,214) as well as Japanese published specification No. 8684/1967.

The aerosol generating means used in the invention is advantageously spaced no more than about 40 mm, preferably no more than about 30 mm, most preferably no more than about 20 mm from the lighting end of the fuel element. The aerosol generator may vary in length from about 2 mm to about 60 mm, preferably from about 5 mm to 40 mm, and most preferably from about 20 mm to 35 mm. The diameter of the aerosol generating means may vary from about 2 mm to about 8 mm, preferably from about 3 to 6 mm. If a non-particulate particulate substrate is used, it may be provided with one or more holes, to increase the surface area of the substrate, and to increase air flow and heat transfer.

The aerosol forming material or materials used in the invention must be capable of forming an aerosol at the temperatures present in the aerosol generating means when heated by the burning fuel element. Such materials preferably will be composed of carbon, hydrogen and oxygen, but they may include other materials. The aerosol forming materials can be in solid, semisolid, or liquid form. The boiling point of the material and/or the mixture of materials can range up to about 500° C. Substances having these characteristics include polyhydric alcohols, such as glycerin and propylene glycol, as well as aliphatic esters of mono-, di-, or poly-carboxylic acids, such as methyl stearate, dimethyldodecandioate, dimethyl tetradecandioate, and others.

The preferred aerosol forming materials are polyhydric alcohols, or mixtures of polyhydric alcohols. Especially preferred aerosol formers are glycerin, propylene glycol, triethylene glycol, or mixtures thereof.

The aerosol forming material may be dispersed on or within the aerosol generating means in a concentration sufficient to permeate or coat the substrate, carrier, or container. For example, the aerosol forming substance may be applied full strength or in a dilute solution by dipping, spraying, vapor deposition, or similar techniques. Solid aerosol forming components may be admixed with the substrate and distributed evenly throughout prior to formation.

While the loading of the aerosol forming material will vary from carrier to carrier and from aerosol forming material to aerosol forming material, the amount of liquid aerosol forming materials may generally vary from about 20 mg to about 120 mg, preferably from about 35 mg to about 85 mg, and most preferably from about 45 mg to about 65 mg. As much as possible of the aerosol former carried on the aerosol generating means should be delivered to the user as WTPM. Preferably, above about 2 weight percent, more preferably above about 15 weight percent, and most preferably above about 20 weight percent of the aerosol former carried on the aerosol generating means is delivered to the user as WTPM.

The aerosol generating means also may include one or more volatile flavoring agents, such as menthol, vanillin, artificial coffee, tobacco extracts, nicotine, caffeine, liquors, and other agents which impart flavor to the aerosol. It also may include any other desirable volatile solid or liquid materials. Alternatively, these optional agents may be placed between the aerosol generating means and the mouthend, such as in a separate substrate or chamber in the passage which leads from the aerosol generating means to the mount end, or in the optional tobacco charge. If desired, these volatile agents may be used in lieu of part, or all, of the aerosol forming material, so that the article delivers a nonaerosol flavor or other material to the user.

One particularly preferred aerosol generating means comprises the aforesaid alumina substrate containing spray dried tobacco extract, tobacco flavor modifiers, such as levulinic acid, one or more flavoring agents, and an aerosol forming material, such as glycerin. This substrate may be mixed with densified tobacco particles, such as those produced on a "Marumerizer", which particles also may be impregnated with an aerosol forming material.

Articles of the type disclosed herein may be used, or may be modified for use, as drug delivery articles, for delivery of volatile pharmacologically or physiologically active materials such as ephedrine, metaproterenol, terbutaline or the like.

As shown in the illustrated embodiments, the smoking article of the present invention also may include a charge or plug of tobacco or a tobacco containing material downstream from the fuel element, which may be used to add a tobacco flavor to the aerosol. In such cases, hot vapors are swept through the tobacco to extract and vaporize the volatile components in the tobacco, without combustion or substantial pyrolysis. One preferred location for the tobacco charge is around the periphery of the aerosol generating means, as shown in FIGS. 11 and 12, which increases heat transfer to the tobacco, especially in embodiments which employ a heat conducting member or conductive container between the aerosol forming material and the peripheral tobacco jacket. The tobacco in these embodiments also acts as an insulating member for the aerosol generator and helps simulate the feel and aroma of a conventional cigarette. Another preferred location for the tobacco charge is within the aerosol generating means, where tobacco or densified tobacco particles may be mixed with, or used in lieu of, the substrate for the aerosol forming materials.

The tobacco containing material may contain any tobacco available to the skilled artisan, such as Burley, Flue Cured, Turkish, reconstituted tobacco, extruded or densified tobacco mixtures, tobacco containing sheets and the like. Advantageously, a blend of tobaccos may be used to contribute a greater variety of flavors. The tobacco containing material may also include conventional tobacco additives, such as fillers, casings, reinforcing agents, such as glass fibers, humectants, and the like. Flavor agents may likewise be added to the tobacco material, as well as flavor modifying agents.

The heat conducting member preferably employed in practicing this invention is typically a metallic (e.g., aluminum) tube, strip, or foil varying in thickness from less than about 0.01 mm to about 0.2 mm or more. The thickness, shape, and/or type of conducting material (e.g., other metals, conductive ceramic materials, or Grafoil from Union Carbide) may be varied to achieve virtually any desired degree of heat transfer. In general, the heat conducting member should be sufficiently recessed to avoid any interference with the lighting of the fuel element, but close enough to the lighting end to provide conductive heat transfer on the early and middle puffs.

As shown in the illustrated embodiments, the heat conducting member preferably contacts or overlaps the rear portion of the fuel element and at least a portion of the aerosol generating means and is recessed or spaced from the lighting end, by at least about 3 mm or more, preferably by about 5 mm or more. Preferably, the heat conducting member extends over no more than about one-half the length of the fuel element. More preferably, the heat conducting member overlaps or otherwise contacts no more than about the rear 5 mm of the fuel element. Preferred recessed members of this type do not interfere with lighting or burning of the fuel element. Preferred recessed conducting members also help to extinguish the fuel when it burns back to the point of contact by the conductor, by acting as a heat sink, and do not protrude, even after the fuel has been consumed.

Preferably, the heat conducting member also forms a conductive container which encloses the aerosol forming materials. Alternatively, a separate conductive container may be provided, especially in embodiments which employ particulate substrates or semi-liquid aerosol forming materials. In addition to acting as a container for the aerosol forming materials, the conductive container improves heat distribution to the aerosol forming materials and the preferred peripheral tobacco jacket and helps to prevent migration of the aerosol former to other components of the article. The container also provides a means for controlling the pressure drop through the article, by varying the number, size, and/or position of the passageways through which the aerosol former is delivered to the mouthend piece of the article. Moreover, in embodiments with a tobacco jacket around the periphery of the aerosol generating means, the container may be provided with peripheral passages or slots to control and direct the flow of vapors through the tobacco. The use of a container also simplifies the manufacture of the article by reducing the number of necessary elements and/or manufacturing steps.

The insulating members which may be employed in practicing the invention are preferably formed into a resilient jacket from one or more layers of an insulating material. Advantageously, this jacket is at least 0.5 mm thick, preferably at least 1 mm thick, and more preferably from about 1.5 to 2.0 mm thick. Preferably, the jacket extends over more than half the length of the fuel element. More preferably, it extends over substantially the entire outer periphery of the fuel element and all or a portion of the aerosol generating means. As shown in the embodiment of FIG. 11, different materials may be used to insulate these two components of the article.

Insulating members which may be used in accordance with the present invention generally comprise inorganic or organic fibers such as those made out of glass, alumina, silica, vitreous materials, mineral wool, carbons, silicons, boron, organic polymers, cellulosics, and the like, including mixtures of these materials. Nonfibrous insulating materials, such as silica aerogel, pearlite, glass, and the like, formed in mats, strips or other shapes, may also be used. Preferred insulating members are resilient, to help simulate the feel of a conventional cigarette. Preferred insulating materials should fuse during use and should have a softening temperature below 650°-700° C. Preferred insulating materials also should not burn during use. However, slow burning carbons and like materials may be employed. These materials act primarily as an insulating jacket, retaining and directing a significant portion of the heat formed by the burning fuel element to the aerosol generating means. Because the insulating jacket becomes hot adjacent to the burning fuel element, to a limited extent, it also may conduct heat toward the aerosol generating means.

Currently preferred insulating materials for the fuel element include ceramic fibers, such as glass fibers. Two suitable glass fibers are available from the Manning Paper Company of Troy, N.Y., under the designations Manniglas 1000 and Manniglas 1200. Preferred glass fiber materials have a low softening point, e.g., below about 650° C. using ASTM test method C338-73. Preferred glass fibers include experimental materials produced by Owens-Corning of Toledo, Ohio under the designations 6432 and 6437, which have a softening point of about 640° C. and fuse during use.

Several commercially available inorganic fibers are prepared with a binder, e.g., PVA, which acts to maintain structural integrity during handling. These binders, which would exhibit a harsh aroma upon heating, should be removed, e.g., by heating in air at about 650° C. for up to about 15 min. before use. If desired, pectin, at about 3 wt. percent, may be added to the fibers to provide mechanical strength to the jacket without contributing harsh aromas.

Alternatively, the insulating material may be replaced, in whole or in part, by tobacco, either loosely packed or tightly packed. The use of tobacco as a substitute for part or all of the insulating jacket serves an additional function by adding tobacco flavors to the mainstream aerosol and producing a tobacco sidestream aroma, in addition to acting as an insulator. In preferred embodiments where the tobacco jacket encompasses the aerosol generating means, the jacket acts as a non-burning insulator, as well as contributing tobacco flavors to the mainstream aerosol. In embodiments where the tobacco encircles the fuel, the tobacco is preferably consumed only to the extent that the fuel source is consumed, i.e., up to about the point of contact between the fuel element and the aerosol generating means. This may be achieved by compressing the tobacco around the fuel element and/or by using a conductive heat sink, as in the embodiment of FIG. 12. It also may be achieved by treating the cigarette paper overwrap and/or the tobacco with materials which help extinguish the tobacco at the point where it overlaps the aerosol generating means.

When the insulating member comprises fibrous materials other than tobacco, there may be employed a barrier means between the insulating member and the mouth end of the article. One such barrier means comprises an annular member of high density cellulose acetate tow which abuts the fibrous insulating means and which is sealed, at either end, with, for example, glue, to block air flow through the tow.

In most embodiments of the invention, the fuel/aerosol generating means combination will be attached to a mouthend piece, such as a foil lined paper or cellulose acetate/plastic tubes illustrated in the Figures, although a mouthend piece may be provided separately, e.g., in the form of a cigarette holder. This element of the article provides the passageway which channels the vaporized aerosol forming materials into the mouth of the user. Due to its length, preferably about 35 to 50 mm or more, it also keeps the hot fire cone away from the mouth and fingers of the user and provides sufficient time for the hot aerosol to form and cool before it reaches the user.

Suitable mouthend pieces should be inert with respect to the aerosol forming substances, may have a water or liquid proof inner layer, should offer minimum aerosol loss by condensation or filtration, and should be capable of withstanding the temperature at the interface with the other elements of the article. Preferred mouthend pieces include the cellulose-acetate tube employed in many of the illustrated embodiments which acts as a resilient outer member and helps simulate the feel of a conventional cigarette in the mouth end portion of the article. Other suitable mouthend pieces will be apparent to those of ordinary skill in the art.

Mouthend pieces useful in articles of the invention may include an optional "filter" tip which is used to give the article the appearance of a conventional filtered cigarette. Such filters include low efficiency cellulose acetate filters and hollow or baffled plastic filters, such as those made of polypropylene. Such filters do not appreciably interfere with aerosol delivery.

The entire length of article or any portion thereof may be overwrapped with cigarette paper. Preferred papers at the fuel element end should not openly flame during burning of the fuel element. In addition, the paper should have controllable smolder properties and should produce a grey, cigarette-like ash.

In those embodiments utilizing an insulating jacket wherein the paper burns away from the jacketed fuel element, maximum heat transfer is achieved because air flow to the fuel source is not restricted. However, papers can be designed to remain wholly or partially intact upon exposure to heat from the burning fuel element. Such papers provide restricted air flow to the burning fuel element, thereby helping to control the temperature at which the fuel element burns and the subsequent heat transfer to the aerosol generating means.

To reduce the burning rate and temperature of the fuel element, thereby maintaining a low $CO/CO_2$ ratio, a non-porous or zero-porosity paper treated to be slightly porous, e.g., non-combustible mica paper with a plurality of holes therein, may be employed as the overwrap layer. Such a paper controls heat delivery, especially in the middle puffs (i.e., puffs 4 through 6).

To maximize aerosol delivery which otherwise would be diluted by radial (i.e., outside) air infiltration through the article, a non-porous paper may be used from the aerosol generating means to the mouth end.

Papers such as these are known in the cigarette paper art and combinations of such papers may be employed to produce various functional effects. Preferred papers used in the articles of the present invention include Ecusta 01788 and 646 plug wrap manufactured by Ecusta of Pisgah Forest, N.C., and Kimerbly-Clark's KC-63-5, P 878-5, P 878-16-2, and 780-63-5 papers.

The aerosol produced by the preferred articles of the present invention is chemically simple, consisting essentially of air, oxides of carbon, water, the aerosol former, any desired flavorants or other desired volatile materials, and trace amounts of other materials. The wet total particulate matter (WTPM) produced by the preferred articles of this invention has no measurable mutagenic activity as measured by the Ames test, i.e., there is no significant dose response relationship between the WTPM produced by preferred articles of the present invention and the number of revertants occurring in standard test microorganisms exposed to such products. See, e.g., Examples 3, 4, and 22, which follow. According to the proponents of the Ames test, a significant dose dependent response indicates the presence of mutagenic materials in the products tested. See Ames et al., Mut. Res. 31:347–364 (1975); Nagao et al., *Mut. Res,* 42:335 (1977).

A further benefit from the preferred embodiments of the present invention is the relative lack of ash produced during use in comparison to ash from a conventional cigarette. As the preferred carbon fuel source is burned, it is essentially converted to oxides of carbon, with relatively little ash generation, and thus there is no need to dispose of ashes while using the article.

The smoking article of the present invention will be further illustrated with reference to the following examples which aid in the understanding of the present invention, but which are not to be construed as limitations thereof. All percentages reported herein, unless otherwise specified, are percent by weight. All temperatures are expressed in degrees Celsius and are uncorrected. In all instances, the smoking articles have a diameter of about 7 to 8 mm, the diameter of a conventional cigarette.

EXAMPLE 1

A smoking article was constructed in accordance with the embodiment of FIG. 1. The fuel element was a 25 mm long piece of blow pipe charcoal, with five 0.040 in. (1.02 mm) longitudinal passages made with a number 60 drill bit. The charcoal weighed 0.375 g. The fuel element was wrapped with conventional treated cigarette paper. The substrate was 500 mg of glass beads (0.64 in. [1.63 mm] average diameter) having two drops, approximately 50 mg, of glycerol coated on their surface. When packed into the tube, this substrate was about 6.5 mm long. The foil lined tube consisted of a 0.35 mil (0.0089 mm) layer of aluminum foil inside a 4.25 mil (0.108 mm) layer of white spirally wound paper tube obtained from Niemand, Inc., Statesville, N.C. This tube surrounded the rear 5 mm of the fuel element. A short (8 mm) piece of cellulose acetate with four grooves around the periphery was used to hold the glass beads against the fuel source. An additional grooved cellulose acetate filter piece of 8 mm length was inserted into the mouth end of the tube to give the appearance of a conventional cigarette. The overall length of the article was about 70 mm.

Models of this type delivered considerable aerosol on the lighting puff, reduced amounts of aerosol on puffs 2 and 3, and good delivery of aerosol on puffs 4 through 9. Models of this type generally yielded about 5–7 mg of wet total particulate matter (WTPM) when machine smoked under FTC smoking procedures of a 35 ml puff volume, a two second puff duration, and a 60 second puff frequency.

EXAMPLE 2

A. Four smoking articles were constructed with 10 mm long pressed carbon fuel elements and glass bead substrates. The fuel elements were formed from 90% PCB-G carbon and 10% SCMC, at about 5000 pounds (2273 kg) of applied load with the tapered lighting end illustrated in FIG. 2A. A single 0.040 in (1.02 mm) hole was formed down the center of each fuel element. Three of the four fuel sources were wrapped with 8 mm wide strips of conventional cigarette paper. The fuel elements were inserted about 2 mm into 70 mm long sections of the foil lined tube described in Example 1. Glass beads, coated with the amount of glycerol indicated in the following table, were inserted into the open end of the foil lined tube and were held against the fuel element by 5 mm long foamed polypropylene filters having a series of longitudinally extending peripheral grooves. A 5 mm long low efficiency cellulose acetate filter piece was inserted into the mouth end of each article. These articles were machine smoked under FTC smoking conditions and the wet total particulate matter (WTPM) was collected on a series of Cambridge pads. The results of these experiments are reported in Table I.

TABLE I

| | Glass Beads (wt) | Aerosol Former (wt) | WTPM (mg)/Puffs 1–3 | 4–6 | 7–9 | 10–12 | Total |
|---|---|---|---|---|---|---|---|
| A | 400.4 mg | 40.5 mg | 8.1 | 4.5 | 0.9 | 0 | 13.5 |
| B* | 405.6 mg | 59.4 mg | 10.2 | 1.9 | 0.7 | 0 | 12.8 |
| C | 404.0 mg | 60.6 mg | 7.6 | 6.9 | 0.4 | 0 | 14.9 |
| C | 803.8 mg | 81.0 mg | 5.9 | 2.5 | 3.7 | 0.9 | 13.0 |

*The fuel rod in this model was not wrapped with cigarette paper.

B. Three smoking articles similar to those described in Example 2A were constructed with 20 mm long blowpipe charcoal fuel elements of the type described in Example 1. These articles were machine smoked under FTC smoking conditions, and the WTPM was collected on a series of Cambridge pads. The results of these tests are reported in Table II.

TABLE II

| | Glass Beads (wt) | Aerosol Former (wt) | WTPM (mg)/Puffs 1–3 | 4–6 | 7–9 | 10–12 | Total |
|---|---|---|---|---|---|---|---|
| E | 402.4 mg | 60.6 mg | 0.1 | 5.4 | 6.2 | 0.6 | 12.3 |
| F* | 404.7 mg | 63.1 mg. | 0.5 | 0.9 | 2.2 | 3.1 | 7.0 |
| G | 500.0 mg | 50.0 mg | 0.3 | 2.9 | 3.0 | 0 | 6.2 |

*The fuel rod in this model was not wrapped with cigarette paper.

EXAMPLE 3

A. Four smoking articles were constructed as shown in FIG. 2 with a 10 mm pressed carbon fuel element having the tapered lighting end illustrated in FIG. 2A. The fuel element was made from 90% PCB-G carbon and 10% SCMC, at about 5000 pounds (2273 kg) of applied load. A 0.040 in. (1.02 mm) hole was drilled down the center of the element. The substrate for the aerosol former was cut and machined to shape from PC25, a porous carbon sold by Union Carbide Corporation, Danbury, Conn. The substrate in each article was about 2.5 mm long, and about 8 mm in diameter. It was loaded with an average of about 27 mg of a 1:1 propylene glycol-glycerol mixture. The foil lined tube mouth-end piece, of the same type as used in Example 1, enclosed the rear 2 mm of the fuel element and the substrate. A plug of Burley tobacco, about 100 mg was placed against the mouth end of the substrate. A short, about 5–9 mm, baffled polypropylene filter piece was placed in the mouth end of the foil lined tube. A 32 mm length of a cellulose acetate filter with a hollow polypropylene tube in the core was placed between the tobacco and the filter piece. The overall length of each article was about 78 mm.

B. Six additional articles were constructed substantially as in Example 3A, but the substrate length was increased to 5 mm, and a 0.040 in (1.02 mm) hole was drilled through the substrate. In addition, these articles did not have a cellulose acetate/polypropylene tube. About 42 mg of the propylene glycol-glycerol mixture was applied to the substrate. In addition, two plugs of Burley tobacco, about 100–150 mg each, were used. The first was placed against the mouth end of the substrate, and the second one was placed against the filter piece.

C. Four additional articles were constructed substantially as in Example 3A, except that an approximately 100 mg plug of flue-cured tobacco containing about six percent by weight of diammonium monohydrogen phosphate was used in lieu of the plug of Burley tobacco.

D. The smoking articles from Examples 3A–C were tested using the standard Ames test. See Ames, et al., *Mut. Res.*, 31:347–364 (1975), as modified by Nagas et al., *Mut. Res.*, 42:335 (1977), and 113:173–215 (1983). The samples 3A and 3C were "smoked" on a conventional cigarette smoking machine using the conditions of a 35 ml puff volume, a two second puff duration, and a 30 second puff frequency, for ten puffs. The smoking articles of Example 3B were smoked in the same manner except that a 60 second puff frequency was used. Only one filter pad was used for each group of articles. This afforded the following wet total particulate matter (WTPM) for the indicated groups of articles:

| | WTPM |
|---|---|
| Example 3A | 63.4 mg |
| Example 3B | 50.6 mg |
| Example 3C | 69.2 mg |

The filter pad for each of the above examples containing the collected WTPM was shaken for 30 minutes in DMSO to dissolve the WTPM. Each sample was then diluted to a concentration of 1 mg/ml and used "as is" in the Ames assay. Using the procedure of Nagao et al., *Mut. Res.*, 42:335–342 (1977), 1 mg/ml concentrations of WTPM were admixed with the S-9 activating system, plus the standard Ames bacterial cells, and incubated at 37° C. for twenty minutes. The bacterial strain used in this Ames assay was *Salmonella typhimurium.* TA 98. See Purchase et al., *Nature*, 264:624–627 (1976). Agar was then added to the mixture, and plates were prepared. The agar plates were incubated for two days at 37° C., and the resulting cultures were counted. Four plates were run for each dilution and the standard deviations of the colonies were compared against a pure DMSO control culture. As shown in Table III, there was no mutagenic activity caused by the WTPM obtained from any of the smoking articles tested. This can be ascertained by comparison of the mean number of revertants per plate with the mean number of revertants obtained from the control (0 μg WTPM/Plate). For mutagenic samples, the mean number of revertants per plate will increase with increasing doses.

TABLE III

| Dose (ug WTPM/Plate) | | Example 3A Mean Revertants/Plate | S.D.* |
|---|---|---|---|
| Control | 0 | 49.3 | 3.4 |
| | 33 | 51.3 | 9.1 |
| | 66 | 50.5 | 7.0 |
| | 99 | 50.8 | 5.2 |
| | 132 | 51.5 | 5.3 |
| | 165 | 53.8 | 10.1 |
| | 198 | 48.3 | 4.6 |
| **Dose (ug WTPM/Plate)** | | **Example 3B Mean Revertants/Plate** | **S.D.*** |
| Control | 0 | 56 | 10.5 |
| | 31.5 | 40 | 7.8 |
| | 63 | 48.3 | 6.3 |
| | 94.5 | 54.0 | 8.4 |
| | 126 | 39 | 4.7 |
| | 157.5 | 42.5 | 9.3 |
| | 189 | 43 | 9.1 |
| **Dose (ug WTPM/Plate)** | | **Example 3C Mean Revertants/Plate** | **S.D.*** |
| Control | 0 | 48.3 | 5.7 |
| | 36 | 50.3 | 9.9 |
| | 72 | 49.0 | 3.9 |
| | 108 | 55.3 | 4.5 |
| | 144 | 43.0 | 6.4 |
| | 180 | 42.3 | 8.8 |
| | 216 | 44.3 | 7.8 |

*Standard Deviation

EXAMPLE 4

Five smoking articles were constructed as shown in FIG. 2. Each article had a 10 mm pressed carbon fuel source as described in Example 3A. This fuel element was inserted 3 mm into one end of a 70 mm long aluminum foil lined tube of the type described in Example 1. A 5 mm long carbon felt substrate, cut from rayon carbon felt sold by Fiber Materials, Inc., was butted against the fuel source. This substrate was loaded with an average of about 97 mg of a 1:1 mixture of glycerin and propylene glycol, about 3 mg of nicotine, and about 0.1 mg of a mixture of flavorants. A 5 mm long section of blended tobacco was butted against the mouth end of the substrate. A 5 mm long cellulose acetate filter piece was placed in the mouth end of the foil lined tube.

These articles were machine smoked under the FTC conditions. The aerosol from these articles was collected on a single Cambridge pad (133.3 mg WTPM), diluted in DMSO to a final concentration of 1 mg WTPM per ml and tested for Ames activity as described in Example 3D using each of the following strains: *Salmonella typhimurium* TA 1535, 1537, 1538, 98, and 100. As shown in Table IV there was no mutagenic activity caused by the WTPM collected from the articles tested.

TABLE IV

| TA 1535 Dose* | Mean Revertants | | TA 1537 Dose* | Mean Revertants | |
|---|---|---|---|---|---|
| Control | 0 | 16 | Control | 0 | 14 |
| | 25 | 13 | | 25 | 13 |
| | 50 | 14 | | 50 | 14 |
| | 75 | 17 | | 75 | 11 |
| | 100 | 14 | | 100 | 13 |
| | 125 | 13 | | 125 | 13 |
| | 150 | 12 | | 150 | 14 |
| **TA 1538 Dose*** | **Mean Revertants** | | **TA 98 Dose*** | **Mean Revertants** | |
| Control | 0 | 15 | Control | 0 | 61 |
| | 25 | 13 | | 25 | 62 |
| | 50 | 22 | | 50 | 47 |
| | 75 | 16 | | 75 | 42 |
| | 100 | 20 | | 100 | 44 |
| | 125 | 19 | | 125 | 39 |
| | 150 | 19 | | 150 | 40 |

| TA 100 Dose* | Mean Revertants |
|---|---|
| Control 0 | 110 |
| 25 | 109 |
| 50 | 105 |
| 75 | 99 |
| 100 | 107 |
| 125 | 108 |
| 150 | 109 |

*ug WTPM/Plate

EXAMPLE 5

A smoking article was built as shown in FIG. 2 with a 10 mm pressed carbon fuel plug having the configuration shown in FIG. 2A, but with no tobacco. The fuel element was made from a mixture of 90% PCB-G activated carbon and 10% SCMC as a binder at about 5000 pounds (2273 kg) of applied load. The fuel element was provided with a 0.040 in (1.02 mm) longitudinal passageway. The substrate was a 10 mm long porous carbon plug made from Union Carbide's PC-25. It was provided with a 0.029 in. (0.74 mm) drilled axial hole, and was loaded with 40 mg of a (1:1) mixture of propylene glycol and glycerol. The foil lined tube, as in Example 1, encircled the rear 2 mm of the fuel element and formed the mouthend piece. The article did not have a filter tip, but was overwrapped with conventional cigarette paper. The total length of the article was 80 mm.

Figure 13:
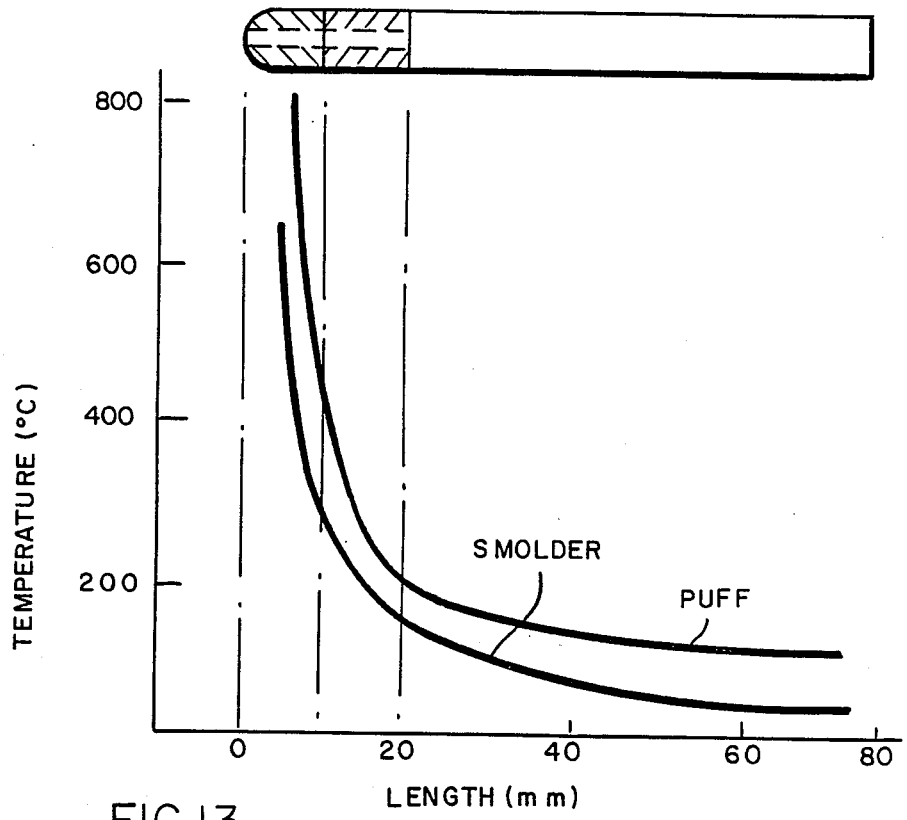
FIG. 13 depicts the average peak temperature profile of the smoking article of Example 5 during use.

The average peak temperatures for this article are shown for both "puff" and "smolder" in FIG. 13. As shown, the temperature declines steadily between the rear end of the fuel element and mouthend. This assures the user of no unpleasant burning sensation when using a product of this invention.

EXAMPLE 6

A smoking article was constructed in accordance with the embodiment of FIG. 3. The fuel element was a 19 mm long piece of blowpipe charcoal, with no longitudinal passageways. Embedded 15 mm into the fuel element was a ⅛ in. (3.2 mm) diameter aluminum rod, 28 mm in length. Four 9mm×0.025 in. (0.64 mm) peripheral grooves, spaced 90° apart were cut into the portion of the aluminum rod which pierced the substrate. The substrate was Union Carbide PC-25 carbon 8 mm in length. The grooves in the aluminum rod extended about 0.5 mm beyond the end of the substrate toward the fuel. The substrate was loaded with 150 mg of glycerol. The foil lined tube, which was the same as in Example 1, enclosed a portion of the rear of the fuel element. A gap was left between the non-burning end of the fuel element and the substrate. A series of holes were cut through the foil lined tube in this gap region to allow for air flow. A similar smoking article was constructed with a pressed carbon fuel plug.

EXAMPLE 7

A smoking article was constructed as shown in FIG. 4 with a fuel source of carbonized cotton fiber. Four slivers of cotton were tightly braided together with cotton string to form a rope with a diameter of about 0.4 in. (10.2 mm). This material was placed in a nitrogen atmosphere furnace which was heated to 950° C. It took about ½ hours to reach that temperature, which was then held for ½ hour. A 16 mm piece was cut from this pyrolyzed material to be used as the fuel element. A 2 mm axial hole 16 was made through the element with a probe. The fuel element was inserted 2 mm into a 20 mm long foil lined tube of the type described in Example 1. 100 mg of Union Carbide PC-25, in granular form, containing 60 mg of a 1:1 propylene glycol-glycerol mixture, was inserted into the foil lined tube. A 5mm long plug of tobacco, about 60 mg, was located immediately behind the granular substrate in the foil lined tube. A 48 mm long annular cellulose acetate tube with an internal 4.5 mm I.D. polypropylene tube was inserted about 3 mm into the foil lined tube. A second foil lined tube, 50 mm in length, was inserted over the cellulose acetate tube until it abutted against the 20 mm foil lined tube. A 5 mm long cellulose acetate filter plug was inserted into the end of this second foil lined tube. The overall length was 84 mm. When lit, this article produced substantial amounts of aerosol throughout the first six puffs with a tobacco flavor.

EXAMPLE 8

A smoking article was constructed as shown in FIG. 5 with a 15 mm long fibrous fuel element substantially as described in Example 7. The capsule 52 was formed from a 15 mm long piece of 4 mil (0.10 mm) thick aluminum foil, which was crimped to form a 12 mm long capsule. This capsule was loosely filled with 100 mg of granulated PG-60, a carbon obtained from Union Carbide, and 50 mg of blended tobacco. The granular carbon was impregnated with 60 mg of a 1:1 mixture of propylene glycol and glycerol. The capsule, the fuel element, and the mouthend piece were united by an 85 mm long piece of conventional cigarette paper.

EXAMPLE 9

A smoking article was constructed in accordance with the embodiment of FIG. 6 with a 7 mm long pressed carbon fuel element containing 90% PXC carbon and 10% SCMC. The longitudinal passageway was 0.040 in. (1.02 mm) in diameter. This fuel plug was inserted into a 17 mm long aluminum foil lined tube so that 3 mm of the fuel element was inside the tube. An 8 mm diameter disc of 3.5 mil (0.089 mm) aluminum foil, with a 0.049 in. (1.24 mm) diameter center hole, was inserted into the other end of the tube and butted against the end of the fuel source.

Union Carbide PG-60 carbon was granulated and sieved to a particle size of −6 to +10 mesh. 80 mg of this material was used as the substrate, and 80 mg of a 1:1 mixture of glycerin and propylene glycol was loaded on this substrate. The impregnated granules were inserted into the foil tube and rested against the foil disk on the end of the fuel source. 50 mg of blended tobacco was loosely placed against the substrate granules. An additional foil disk with a 0.049 in. (1.24 mm) central hole was inserted into the foil tube on the mouth end of the tobacco. A long hollow cellulose acetate rod with a hollow polypropylene tube as described in Example 7 was inserted 3 mm into the foil lined tube. A second foil lined tube was inserted over the cellulose acetate rod against the end of the 17 mm foil lined tube.

This model delivered 11.0 mg of aerosol in the first three puffs when "smoked" under FTC conditions. Total aerosol delivery for nine puffs was 24.9 mg.

EXAMPLE 10

A smoking article having the fuel element and substrate configuration of FIG. 7 was made using a 15 mm long annular pressed carbon fuel element with an inner diameter of about 4 mm and an outer diameter of about 8 mm. The fuel was made from 90% PCB-G activated carbon and 10% SCMC. The substrate was a 10 mm long piece formed of Union Carbide PC-25 carbon with an external diameter of about 4 mm. The substrate, loaded with 55 mg of a 1:1 glycerin/propylene glycol mixture, was inserted within the end of the fuel closer to the mouth end of the article. This fuel/substrate combination was inserted 7 mm into a 70 mm foil lined tube which had a short cellulose acetate filter at the mouthend. The length of the article was about 77 mm.

The article delivered substantial amounts of aerosol on the first three puffs, and over the useful life of the fuel element.

EXAMPLE 11

A modified version of the smoking article of FIG. 10 was made as follows:

A 9.5 mm long carbon fuel source with a 4.5 mm diameter and a single, 1 mm diameter longitudinal passageway was extruded from a mixture of 10% SCMC, 5% potassium carbonate, and 85% carbonized paper mixed with 10% water. The mixture had a dough-like consistency and was fed into an extruder. The extruded material was cut to length after drying a 80° C. overnight.

The capsule was made from a 22 mm long piece of 0.0089 mm thick aluminum formed into a cylinder of 4.5 mm I.D. One end of this capsule was crimped to form an end wall having a small central hole. The capsule was filled with (a) 70 mg of vermiculite containing 50 mg of a 1:1 mixture of propylene glycol and glycerin, and (b) 30 mg of burley tobacco to which 6% glycerin and 6% propylene glycol had been added.

The fuel source and macrocapsule were joined by inserting the fuel source about 2 mm into the end of the macrocapsule. A 35 mm long polypropylene tube of 4.5 mm I.D. was inserted over the other end of the capsule. The fuel source, capsule and polypropylene tube were thus joined to form a 65 mm long, 4.5 mm diameter segment. This segment was wrapped with several layers of Manniglas 1000 from Manning Paper Company until a circumference of 24.7 mm was reached. The unit was then combined with a 5 mm long cellulose acetate filter and wrapped with cigarette paper.

When smoked under FTC conditions, the article delivered 8 mg of WTPM over the initial three puffs; 7 mg WTPM over puffs 4–6; and 5 mg WTPM over puffs 7–9. Total aerosol delivery over the 9 puffs was 20 mg. When placed horizontally on a piece of tissue paper, the article did not ignite or even scorch the tissue paper.

EXAMPLE 12

A smoking article was constructed in accordance with the embodiment of FIG. 8 in the following manner:

Saffil alumina low density fibers were obtained from ICI Americas, Inc. in mat form. These fibers were 95% $Al_2O_3$, 5% $SiO_2$, and had a fiber diameter of from 2 to 4 microns. The mat was slit to a width such that long narrow bands of the material could be fed through a conventional cigarette filter maker. The filter maker compressed the mat while wrapping it with a conventional cigarette plug wrap. The resulting product was a continuous rod of Saffil alumina fibers with an appearance similar to that of a conventional cellulose acetate cigarette filter. These rods were cut to 10 mm length. A boring tool was used to form a 4 mm diameter passageway through the center of the alumina segments.

A 10 mm long carbon fuel source of approximately 4.5 mm o.d. was inserted into the passageway of the alumina segment such that the alumina fibers formed an insulating, resilient jacket around the fuel source. The fuel source was 90% PCB-G, obtained from Calgon Carbon Corp., and 10% SCMC formed at a pressure of about 5000 pounds (2273 kg) of applied load. A passageway of 1.02 mm diameter extended through the fuel source.

The jacketed fuel source was inserted approximately 2 mm inside a foil-lined paper tube obtained from Neimand, Inc., Statesville, N.C. This tube consisted of a 0.35 mil (0.0089 mm) layer of aluminum foil inside a 4.25 mil (0.108 mm) layer of white spirally wound paper. A substrate piece was abutted against the jacketed fuel source. The substrate was formed from Union Carbide's PC-25 material. It was machined to a length of about 10 mm and a diameter of about 7–8 mm with a continuous central passageway of about 0.016 inch (0.4 mm) diameter. Approximately 60 mg of a solution of glycerin and propylene glycol (1:1 ratio) were applied to the substrate. A cellulose acetate filter piece of approximately 10 mm length was inserted into the mouth end of the foil-lined tube.

The model showed improved ease-of-lighting when compared to a similar smoking article without the alumina jacket. The carbon fuel source glowed red even between puffs. Aerosol delivery was low on the initial three puffs and increased greatly on subsequent puffs. Overall appearance was greatly improved. The insulating effects of the ceramic fiber jacket were evidenced by substantially lower peripheral heat loss.

EXAMPLE 13

Modified versions of the smoking article illustrated in FIG. 10 were made from an extruded carbon fuel source in the following manner:

A. Fuel Source Preparation

Grand Prairie Canadian Kraft paper made from hardwood and obtained from Buckeye Cellulose Corp., Memphis, Tenn., was shredded and placed inside a 9" diameter, 9" deep stainless steel furnace. The furnace chamber was flushed with nitrogen, and the furnace temperature was raised to 200° C. and held for 2 hours. The temperature in the furnace was then increased at a rate of 5° C. per hour to 350° C. and was held at 350° C. for 2 hours. The temperature of the furnace was then increased at 5° C. per hour to 650° C. to further pyrolize the cellulose. Again the furnace was held at that temperature for 2 hours to assure uniform heating of the carbon. The furnace was then cooled to room temperature and the carbon was ground into a fine powder (less than 400 mesh) using a "Trost" mill. This powdered carbon had a tapped density of 0.6 grams/cubic centimeter and hydrogen plus oxygen level of 4%.

Nine parts of this carbon powder was mixed with one part of SCMC power, $K_2CO_3$ was added at 1 wt. percent, and water was added to make a thin slurry, which was then cast into a sheet and dried. The dried sheet was then reground into a fine powder and sufficient water was added to make a plastic mix which was stiff enough to hold its shape after extrusion, e.g., a ball of the mix showed only a slight tendency to flow in a one day period. This plastic mix was then loaded into a room temperature batch extruder. The female extrusion die for shaping the extrudant had tapered surfaces to facilitate smooth flow of the plastic mass. A low pressure (less than 5 tons per square inch or $7.03 \times 10^6$ kg per square meter) was applied to the plastic mass to force it through a female die of 4.6 mm diameter. The wet rod was then allowed to dry at room temperature overnight. To assure that it was completely dry it was then placed into an oven at 80° C. for two hours. This dried rod had a density of about 0.9 g/cc, a diameter of 4.5 mm, and an out of roundness of approximately 3%.

Figure 9A:
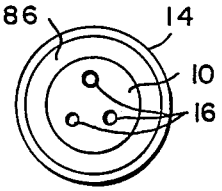
Figure 9B:
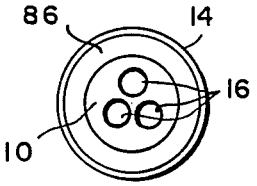

The dry, extruded rod was cut into 10 mm lengths and three 0.5 mm holes were drilled through the length of the rod as illustrated in FIG. 9A, but spaced closer together.

B. Assembly

Metallic containers for the substrate were 30 mm long spirally wound aluminum tubes obtained from Niemand, Inc., having a diameter of about 4.5 mm. One end of each of these tubes was crimped to form an end with a small hole. Approximately 180 mg of PG-60, a granulated carbon obtained from Union Carbide, was used to fill each of the containers. This substrate material was loaded with approximately 75 mg of a 1:1 mixture of glycerin and propylene glycol. After the metallic containers were filled, each was joined to a fuel rod by inserting about 2 mm of the fuel rod into the open end of the container. Each of these units was then joined to a 35 mm long polypropylene tube of 4.5 mm internal diameter by inserting one end of the tube over the walled end of the container.

Each of these core units was placed on a sheet of Manniglas 1200, pretreated at about 600° C. for up to about 15 min. in air to eliminate binders, and rolled until the article was approximately the circumference of a cigarette. An additional double wrap of Manniglas 1000 was applied around the Manniglas 1200. The ceramic fiber jacket was cut away from the mouth end exposing 10 mm of the polypropylene tube and a 10 mm long annular segment of cellulose acetate filter material replaced the fiber jacket. The end of this segment was heavily coated with a conventional adhesive to block air flow through the filter material. A conventional cellulose acetate filter plug of 10 mm length was butted against the adhesive. The entire unit was then wrapped with ECUSTA 01788 perforated cigarette paper, and a conventional tipping paper was applied to the mouth end.

Smoking articles with three 0.5 mm holes in the fuel rod, as shown in FIG. 9A, but spaced closer together, demonstrated increased aerosol on the immediate second puff (i.e., a puff taken two seconds after the lighting puff) when compared to an article with a single hole fuel source. Smoking articles made with more than three holes, such as the 9 hole rod shown in FIG. 12A and the "wedge" shaped hole configuration of FIG. 10C produced even more aerosol on the immediate second puff, with the 9 hole embodiment producing remarkably increased immediate second puff aerosol when compared to a single hole fuel source.

Similar smoking articles have been prepared with tobacco, either mixed with or used in lieu of the substrate, with similar results.

EXAMPLE 14

A modified version of the smoking article illustrated in FIG. 10 was made from an all carbon extruded fuel source in the following manner. An extruded fuel source was made as outlined in Example 13A, except that an internal mandrel was used to form 4 holes of roughly triangular i.e., "wedge" shape, in the fuel source, as shown in FIG. 10C. The fuel source thus had a cross shaped web of about 0.75 mm and an outer wall of about 1 mm. A rod of this material was coated on the exterior surface with a mixture of Shell 815 epoxy and Magnolia 544-A hardening agent. The rod was heated to 150° C. for 30 minutes to cure the epoxy. The rod was then heated in a tube furnace to 650° C. in approximately 30 minutes in a nitrogen atmosphere to carbonize the SCMC and epoxy. The resultant all carbon fuel was cut to a 10 mm length, which weighed 0.092 grams. This fuel rod was formed into a smoking article in the manner described in Example 13B. The lighting and burning characteristics of this all carbon structure were not significantly different from the SCMC containing fuel sources employed in Example 13.

EXAMPLE 15

Additional smoking articles were prepared in accordance with the provisions of Example 13, with a specially prepared glass fiber material obtained from Owens-Corning Fiberglas of Toledo, Ohio, which was formed into a glass fiber paper having a thickness of about 0.005 inches (5 mils) (ASTM Method D 647, using a low pressure PMI gauge (7.3 psi)). This was used in place of the Manniglas materials. Use of this alkaliborosilicate material, which had a 679° C. softening point and a fiber diameter of about 9 microns, afforded a ceramic jacket having several layers, which fused to a porous mass upon heating by the burning fuel element. This fused mass was acceptable in appearance, i.e., the article retained a cigarette-like shape while producing aerosol in quantities similar to Examples 13 and 14.

EXAMPLE 16

Fuel elements (10 mm long, 4.5 mm diameter) were prepared in a manner similar to Example 13, except that the number and arrangement of passageways was modified as described herein.

Figure 14:
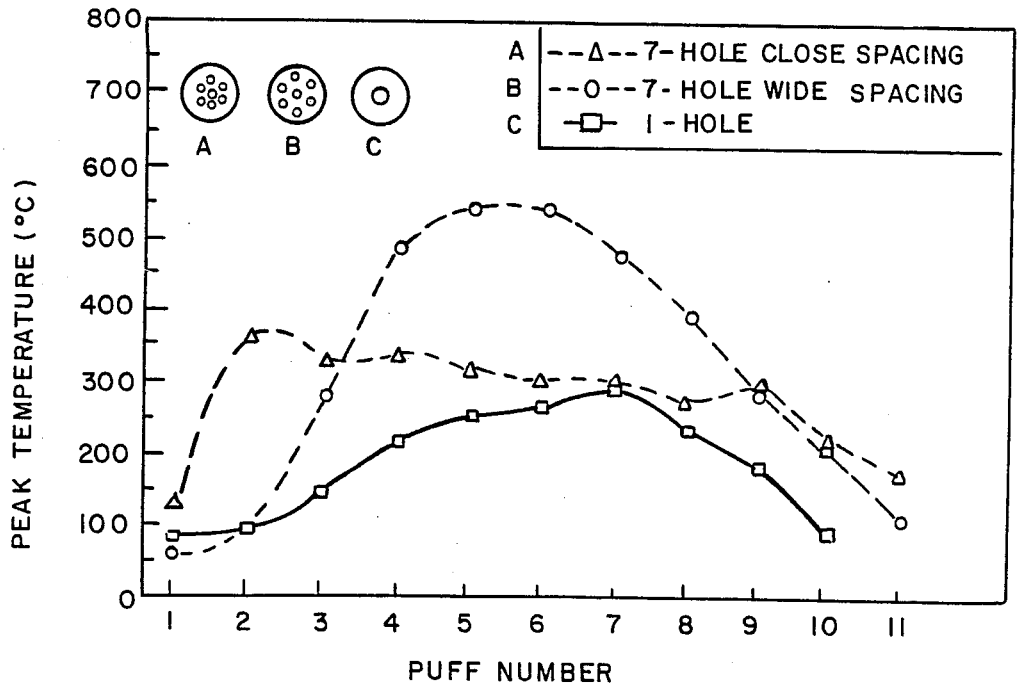
FIG. 14 illustrates the fuel element temperature profiles for fuel elements 14A, 14B, and 14C.

FIG. 14 represents the results of puff temperature measurements for the fuel elements of this example using a 35 ml puff volume and a two second puff duration. The temperature measurements for puff 1 were taken one second after ignition with an infrared heater, and the temperature measurements for puff 2 were taken five seconds after ignition. Subsequent puffs were taken at 60 second intervals. The temperatures were all measured 15 mm behind the fuel element, which was inserted about 2 to 3 mm inside an empty metal tube.

The fuel element of Example 14A had 7 holes (ea. d=0.5 mm), arranged in a closely spaced pattern as shown at A in FIG. 14. The core diameter of fuel element A was about 1.9 mm and the spacing between these holes was about 0.2 mm. This fuel element delivered the most heat on the first and second puffs as shown in FIG. 14. During burning, the fuel between the holes burned away and a single large hole was formed at the lighting end of the fuel element, i.e., the passageways coalesced.

The fuel element of example 14B had 7 holes (ea. d=0.5 mm) in a widely spaced pattern shown at B in FIG. 14. The core diameter of fuel element B was about 3.0 mm and the spacing between the holes was about 0.75 mm. The passageways in this fuel element did not coalesce during the burning of the fuel element.

The fuel element of example 14C had a single 1.5 mm diameter axial hole as shown at C in FIG. 14. When ignited with an infrared heater, the fuel element ignited along its outer edge and the combustion area spread slowly across the face of the element.

EXAMPLE 17

Fuel elements were prepared in a manner similar to Example 13 having an apparent (bulk) density of about 0.92 g/cc. Between the ceramic jacket and the overwrap paper was a layer of nonporous, nonburning, experimental mica paper obtained from Corning Glass Works, Corning, N.Y., and believed to be prepared in accordance with the teachings of U.S. Pat. No.

4,297,139. This paper was provided with twenty-one 3/32 inch diameter holes in the 10 mm long area around the fuel element to afford about 48% open area around the fuel element.

When smoked under FTC conditions, using a hollow metal tube as in Example 16, the average mainstream CO delivery for fuel elements having a closely spaced seven hole arrangement with a core diameter of about 2.2 mm (similar to fuel element A in FIG. 14) was 22 mg over a total of 12 puffs. The average CO delivery for fuel elements having the widely spaced hole arrangement (similar to fuel element B in FIG. 14), with a core diameter of about 3.0, was 33 mg over 11 puffs. The average mainstream CO delivery for single hole fuel elements (similar to fuel element C in FIG. 14, d=2.5 mm) was 5 mg over nine puffs.

EXAMPLE 18

A fuel element was prepared in a manner similar to Example 16 with the widely spaced 7 hole arrangement similar to B in FIG. 14. The seven holes extended back only 1 mm from the lighting end of the fuel element where they opened into a large cavity (2.5 mm in diameter) which extended to the mouth end of the fuel element, as shown in FIG. 12B. When smoked under FTC conditions, using a hollow metal tube as in Example 16, the CO delivery for this fuel element was 9 mg over a total of 9 puffs, for an average delivery of 1 mg CO per puff.

EXAMPLE 19

Fuel elements were prepared in a manner similar to Example 13, with fuel element passageways as described herein.

In addition to carbonized paper and SCMC binder, fuel element 19 A (10 mm×4.5 mm) included 20 wt. percent Burley tobacco within the extruded mixture. The fuel element had four wedge shaped passageways similar to that shown in FIG. 10C.

Example 19B utilized a fuel element (10 mm×4.47mm) with nine passageways (six outer periphery, 3 tight packed in center) i.e., similar to that shown in FIG. 12A. The three central passageways extended into the fuel element 2 mm and met a central cavity (8 mm×1.5 mm), similar to that shown in FIG. 12B, which contained 25 mg of "Marumerized" (i.e., densified) flue cured tobacco (particles about 1 mm×0.3 mm).

Metallic capsules were prepared as in Example 13, part B. Glycerin (8.0 grams) was admixed with 4.0 grams of finely ground (1.0 to 30 micron) spray dried tobacco extract, prepared as described below. PG-60 granulated carbon (12.0 grams) was added to the slurry which was then stirred until the substrate was dry to the touch. Such a treated substrate was used to load the metallic capsule.

The tobacco extract used in this example was prepared as follows. Tobacco was ground to a medium dust and extracted with water in a stainless steel tank at a concentration of from about 1 to 1.5 pounds tobacco per gallon water. The extraction was conducted at ambient temperature using mechanical agitation for from about 1 hour to about 3 hours. The admixture was centrifuged to remove suspended solids and the aqueous extract was spray dried by continuously pumping the aqueous solution to a conventional spray dryer, such as an Anhydro Size No. 1, at an inlet temperature of from about 215° to 230° C. and collecting the dried powder material at the outlet of the drier. The outlet temperature varied from about 82° to 90° C.

Three articles of Example 19A and four articles of example 19B were smoked without mouthend pieces, and the WTPM for each group was collected on a single pad. The articles were smoked on a conventional cigarette smoking machine using the conditions of a 50 ml puff volume, a two second puff duration, and a 30 second puff frequency, for ten puffs (Ex. 19A) or thirteen puffs (Ex. 19B). This afforded the following wet total particulate matter (WTPM) for the indicated groups of articles:

| | TOTAL WTPM | AVERAGE WTPM PER ARTICLE |
|---|---|---|
| Example 19A | 141.3 mg | 47.1 mg |
| Example 19B | 199.4 mg | 49.8 mg |

EXAMPLE 20

A preferred smoking article of the present invention, of the type illustrated in FIG. 11, was prepared in the following manner:

A 10 mm long, 4.5 mm o.d. fuel element having an apparent (bulk) density of about 0.86 g/cc, was prepared with 10 wt. percent spray dried flue cured tobacco extract (prepared in accordance with Example 19) in addition to carbon, SCMC binder (10 wt. percent) and $K_2CO_3$ (1 wt. percent). The carbon was prepared in a manner similar to Example 13, but at a carbonizing temperature of 750° C. After cooling, the carbon was ground to a mesh size of minus 200. The powdered carbon was then heated to a temperature of 650° C. to 750° C. to remove volatiles, and then used to prepare a stiff dough for extrusion. The fuel element was extruded with seven holes (each about 0.6 mm diameter) in a closely spaced arrangement (similar to FIG. 11A) with a core diameter of about 2.6 mm and spacing between the holes of about 0.3 mm.

The capsule was prepared from aluminum tubing, about 0.1 mm thick, about 4.5 mm outer diameter, and about 30 mm in length. The rear 2 mm of the capsule was crimped to seal the mouth end of the capsule. At the mouth end, four equally spaced grooves were indented in the side of the capsule, each to a depth of about 0.75 mm to afford a "lobe-shaped" capsule similar to that illustrated in FIG. 11B. This was accomplished by inserting the capsule into a die having four equally spaced wheels of about 0.75 mm depth located such that the rear 18 mm of the capsule was grooved to afford four equally spaced channels. Four holes (each about 0.72 mm diameter) were made in the capsule at the transition between the ungrooved portion of the capsule and each of the grooves (as shown at 107 in FIG. 11B). In addition, a central hole of the same diameter was made in the sealed end of the capsule, approximately 17 mm from the holes at the fuel end of the grooves.

The capsule was filled with a 1:1 mixture of densified (i.e., Marumerized) flue cured tobacco having a density of about 0.8 g/cc, loaded with 15 wt. percent glycerin, and a treated alumina substrate. The alumina (surface area=280 $m^2/g$) from W.R. Grace & Co. (designated SMR-14-1896), having a mesh size of from −8 to +14 (U.S.), was sintered at a soak temperature between about 1400° to 1550° C., for about one hour, and cooled. The alumina was washed with water and dried. The alumina (640 mg) was treated with an aqueous solution containing 107 mg of spray dried flue cured tobacco extract (prepared as in Example 19) and dried to a moisture content of from about 1 to 5, preferably about 3.5, weight percent. This material was then treated with a mixture of 233 mg of glycerin and 17 mg of a flavor component obtained from Firmenich, Geneva, Switzerland, under the designation T69-22.

The fuel element was inserted into the open end of the filled macrocapsule to a depth of about 3 mm. The fuel element macrocapsule combination was overwrapped at the fuel element end with a 10 mm long, glass fiber jacket of Owens-Corning 6432 (having a softening point of about 640° C.), with 3 wt. percent pectin binder, to a diameter of about 8 mm, which was overwrapped with Ecusta 646 plug wrap.

An 8 mm diameter tobacco filler cigarette rod with an Ecusta 646 plug wrap overwrap was cut to a 28 mm length and was modified to have a longitudinal passageway of about 4.5 mm diameter in the center. The jacketed fuel element - capsule combination was inserted into the tobacco rod passageway until the glass fiber jacket abutted the tobacco. The glass fiber and tobacco sections were overwrapped with Kimberly-Clark P 878-16-2 paper.

A 30 mm long cellulose acetate mouthend piece overwrapped with Ecusta 646 and containing a 28 mm long polypropylene tube, recessed 2 mm from the fuel element end, as illustrated in FIG. 11, was joined to a 10 mm long filter element having an overwrap of Ecusta 646 plug wrap by a layer of KC P 878-16-2 paper. This mouthend piece section was joined to the jacketed fuel element - capsule section by tipping paper.

During use, heated air and gases normally enter the tobacco jacket through the glass fiber jacket and the holes in the capsule. A portion of the aerosol forming material also will enter the jacket through the holes.

The foregoing preferred embodiment may be modified to incorporate one or more of the following changes: (a) the capsule may be a tube having a crimped mouth end only, with or without peripheral passages, or the shape of the mouthend portion of the capsule may be crimped into a rectangular, square, or other shape; (b) levulinic acid, at about 0.7 weight percent, may be added to the substrate; (c) the flavor materials may be added to the tobacco jacket instead of, or in addition to, the substrate; and (d) the container need not contain Marumerized tobacco.

EXAMPLE 21

A preferred smoking article of the type illustrated in FIG. 12 was prepared in the following manner:

The fuel element (7 mm long, 5.2 mm o.d) was prepared in a manner similar to that described in Example 20, but 12 holes (each about 0.6 mm diameter) were drilled near the peripheral edge (see FIG. 12A).

The macrocapsule was prepared from 0.1 mm thick, 4.5 mm outer diameter aluminum tubing, about 30 mm in length. This tubing was sealed by crimping one end. The sealed capsule (27 mm in length) was drawn so that about 23 mm of the sealed, i.e., mouth end, portion of the capsule, was reduced in diameter to about 4 mm. A portion (about 3 mm) of the open end of the capsule was expanded in diameter to about 5.1 mm. A die/pin arrangement having a small diameter (4 mm) for about 23 mm and wide diameter (4 mm) for about 3 mm enabled the rapid production of the capsules. Two slits (about 13 mm long) were cut into the mouth end of the capsule, beginning about 7 mm from the fuel element end of the capsule. The cuts were made tangentially such that the openings flared out from the side of the capsule about 1 mm and such that the substrate did not fail out.

This capsule was filled with about 170 mg of the alumina substrate of Example 20. This substrate consisted of about 68 weight percent alumina, 11.3 weight percent spray dried flue cured tobacco extract (prepared as in Example 19), 18.1 weight percent glycerin, 0.7 weight percent levulinic acid, and 1.9 weight percent T69-22 flavor. The fuel element was inserted into the open end of the capsule, to a depth of about 2.5 mm.

A tobacco rod, about 32 mm in length, (e.g., from a non-filtered cigarette) was modified with a stepped probe to compact the tobacco and form a longitudinal passageway of about 5.6 mm diameter (for about 10 mm) and about 4.3 mm diameter (for about 22 mm). This tobacco rod was connected by a paper overwrap to a cellulose acetate mouthend piece (30 mm) having a conventional filter element (10 mm).

The fuel element/capsule combination was then inserted into the passageway in the tobacco rod to complete the assembly of the article.

What is claimed is:

1. A smoking article comprising:

(a) a carbonaceous fuel element;

(b) a physically separate aerosol generating means longitudinally disposed behind the fuel element, including an aerosol forming material; and (c) a heat conducting member for conducting heat from the fuel element to the aerosol generating means, the conducting member being spaced behind the lighting end of the fuel element.

2. The article of claim 1, wherein the conducting member is spaced at least about 5 mm behind the lighting end of the fuel element.

3. The article of claim 1, wherein the conducting member circumscribes a portion of the fuel element.

4. The article of claim 3, wherein the conducting member contacts the fuel element along less than about one-half of its length.

5. The article of claim 3, wherein the conducting member contacts the fuel element along no more than about 5 mm of its length.

6. A cigarette-type smoking article of claim 1, 2, 3, 4, or 5, wherein the fuel element is less than about 20 mm in length prior to smoking.

7. The article of claim 6, wherein the fuel element is provided with a plurality of longitudinal passageways.

8. A cigarette-type smoking article of claim 1, 2, 3, 4, or 5, wherein the fuel element is less than about 30 mm in length prior to smoking.

9. The article of claim 8, wherein the fuel element is provided with a plurality of longitudinal passageways.

10. The article of claim 9, wherein at least a portion of the passageways coalesce during burning, at least at the lighting end of the element.

11. The article of claim 1, 2, 3, 4, or 5 further comprising an insulating member circumscribing at least a portion of the fuel element.

12. A cigarette-type smoking article of claim 11, wherein the insulating member is at least 0.5 mm thick.

13. The article of claim 12, further comprising a resilient insulating member circumscribing at least a portion of the aerosol generating means.

14. The article of claim 13, further comprising a mouthend piece having an aerosol delivery passage circumscribed by a resilient outer member.

15. A cigarette-type smoking article of claim 11, wherein the insulating member comprises a resilient mass of fibers which fuses during use.

16. A cigarette-type smoking article of claim 1, 2, 3, 4, or 5, wherein the conducting member at least partially encloses the aerosol forming material.

17. The article of claim 16, further comprising a charge of tobacco located between the mouth end of the fuel element and the mouth end of the article.

18. The article of claim 16, further comprising a nonburning insulating member which circumscribes at least a portion of the fuel element.

19. The article of claim 18, wherein at least a portion of the conducting member which encloses the aerosol forming material is circumscribed by tobacco.

20. The article of claim 19, further comprising a mouthend piece having an aerosol delivery passage circumscribed by a resilient outer member.

21. The article of claim 18, wherein the insulating member comprises a resilient mass of inorganic fibers which fuses during use.

22. The article of claim 1, 2, 3, 4, or 5, wherein the article delivers at least about 0.5 mg of wet total particulate matter in the first three puffs.

23. The article of claim 1, 2, 3, 4, or 5, wherein the article delivers an average of at least about 0.8 mg per puff of wet total particulate matter under FTC smoking conditions, for at least 6 puffs.

24. The article of claim 1, 2, 3, 4, or 5, which produces wet total particulate matter having no mutagenic activity as measured by the Ames test.

25. The smoking article of claim 1, wherein the fuel element is less than about 30 mm in length prior to smoking and has a diameter of from about 3 mm to about 7 mm.

26. The smoking article of claim 1, or 25 wherein the fuel element is less than about 30 mm in length prior to smoking and has a diameter of from about 3 mm to about 6 mm.

27. The smoking article of claim 26, wherein the fuel element is less than about 15 mm in length prior to smoking.

28. The smoking article of claim 26, wherein the fuel element is about 10 mm or less in length prior to smoking.

29. The smoking article of claim 1, or 25, wherein the heat conducting member contacts both the fuel element and the aerosol generating means.

30. The smoking article of claim 25, wherein the fuel element is less than about 15 mm in length prior to smoking.

31. The smoking article of claim 25, wherein the fuel element is about 10 mm or less in length prior to smoking.

32. A cigarette-type smoking article of claim 1, 2, or 5, wherein he fuel element is at the lighting end of the article and is less than 20 mm in length prior to smoking, and further comprising an insulating material at least 0.5 mm thick which circumscribes at least a portion of the fuel element.

33. The smoking article of claim 32, wherein the fuel element is less than about 15 mm in length prior to smoking.

34. The smoking article of claim 32, wherein the aerosol forming material is located within a heat conductive container, and a resilient insulating member circumscribes at least a portion of the container.

35. The smoking article of claims 1, 2, 3, 4, 5 or 25, further comprising a charge of tobacco located between the mouthend of the fuel element and the mouthend of the article.

36. The smoking article of claims 1, 2, 3, 4, 5 or 1, further comprising a mass of tobacco circumscribing at least a portion of the longitudinal periphery of the aerosol generating means.

37. The smoking article of claims 1 or 2, further comprising a paper wrapper encircling at least a portion of the longitudinal periphery of the article.

38. A cigarette-type smoking article comprising:

(a) a carbonaceous fuel element less than about 30 mm in length prior to smoking;

(b) a physically separate aerosol generating means longitudinally disposed behind the fuel element, including an aerosol forming material;

(c) heat conducting member for conducting heat from the fuel element to the aerosol generating means, the conducting member being spaced behind the lighting end of the fuel element; and (d) an insulating member comprising nonburning material at least 0.5 mm thick which circumscribes at least a portion of the fuel element.

39. The article of claim 38, further comprising a resilient insulating member circumscribing at least a portion of the aerosol generating means.

40. The article of claim 39, wherein the insulating member surrounding the aerosol generating means comprises tobacco.

41. The article of claim 38, wherein the aerosol forming material is located within a heat conductive container and a resilient insulating member circumscribes at least a portion of the container.

42. The article of claim 41, wherein the insulating member circumscribing the aerosol generating means comprises tobacco and the container is provided with at least one passageway through which the aerosol forming material may enter the tobacco during smoking of the article.

43. The article of claim 38, 39, 40, 41 or 42 wherein the insulating member which circumscribes the fuel element comprises fibers which fuse during use.

44. The article of claim 38, 39, 40, 41, or 42, wherein the insulating member which circumscribes the fuel element comprises fibers having a softening temperature of about 650° C. or less.

45. The article of claim 38, 39, 40, 41, or 42, wherein the heat conducting member contacts the fuel element along less than about one-half of its length.

46. The article of claim 38, 39, 40, 41, or 42, wherein the heat conducting member circumscribes the nonlighting end of the fuel element.

47. The article of claim 38, 39, 40, 41, or 42 wherein the fuel element is provided with a plurality of longitudinal passageways.

48. The article of claim 47, wherein the fuel element has a density greater than about 0.7 g/cc.

49. The article of claim 47, wherein at least a portion of the passageways coalesce during burning, at least at the lighting end of the element.

50. The article of claim 38, 39, 40, 41, or 42, wherein the fuel element is less than about 20 mm in length prior to smoking.

51. The article of claim 50, wherein the fuel element is provided with a plurality of longitudinal passageways.

52. The article of claim 50, wherein the heat conducting member contacts the fuel element along less than about one-half of its length.

53. The article of claim 38, 39, 40, 41, or 42, further comprising a mouthend piece having an aerosol delivery passage circumscribed by a resilient outer member.

54. A cigarette-type smoking article comprising:

(a) a carbonaceous fuel element;

(b) an insulating member surrounding at least a portion of the periphery of the fuel element;

(c) a heat conductive container longitudinally disposed behind the fuel element and containing an aerosol forming material; and (d) a physically separate mass of tobacco surrounding at least a portion of the periphery of the heat conductive container;

whereby upon lighting the fuel element generates heat to volatilize the aerosol forming material located in the conductive container.

55. The article of claim 54, further comprising a mouthend piece having an aerosol delivery passageway circumscribed by a resilient outer member.

56. The article of claim 54, wherein the conductive container contacts the fuel element.

57. The article of claim 54, further comprising a heat conducting member which contacts the fuel element to transfer heat from the fuel element to the aerosol forming material.

58. The article of claim 54, 55, 56, or 57 wherein the insulating member comprises a resilient mass of inorganic fibers which fuses during use.

59. The article of claim 54, 55, 56, or 57 wherein the fuel element is less than 20 mm in length prior to smoking.

60. The article of claim 59, wherein the fuel element is provided with a plurality of longitudinal passageways.

61. The article of claim 60, wherein at least a portion of the passageways coalesce during burning, at least at the lighting end of the element.

62. The article of claim 59, wherein the heat conducting member contacts the fuel element along less than about one-half of its length.

63. A cigarette-type smoking article comprising:

(a) a carbonaceous fuel element less than about 30 mm in length prior to smoking, having a plurality of longitudinal passageways;

(b) a physically separate aerosol generating means longitudinally disposed behind the fuel element, including an aerosol forming material; and (c) a heat conducting member spaced behind the lighting end of the fuel element which circumscribes the non-lighting end of the fuel element and encloses the aerosol forming material;

(d) a resilient, non-burning insulating member at least 0.5 mm thick which circumscribes at least a portion of the fuel element; and (e) a mass of tobacco circumscribing the portion of the conducting member which encloses the aerosol forming material.

64. The article of claim 63, wherein the fuel element is less than 15 mm in length.

65. The article of claim 63, wherein at least a portion of the passageways coalesce during burning, at least at the lighting end of the element.

66. The article of claim 63, wherein the insulating member fuses during use.

67. The article of claim 63, wherein the insulating member comprises fibers having a softening temperature of about 650° C. or less.

68. The article of claim 66 or 67, wherein the insulating member comprises ceramic or glass fibers.

69. The article of claim 66 or 67, wherein the fuel element is less than about 15 mm in length.

70. The article of claim 63, 64, 65, 66, or 67, further comprising a mouthend piece having an aerosol delivery passageway circumscribed by a resilient outer member.

71. The article of claim 38, 40, 42, 54, 63, or 64, which produces wet total particulate matter having no mutagenic activity, as measured, by the Ames test.

72. The article of claim 38, 39, 41, 54, 56, 57, or 63, wherein the article delivers at least about 0.6 mg of wet total particulate matter in the first three puffs.

73. The article of claim 38, 39, 41, 54, 56, 57, or 63, wherein the article delivers an average of at least about 0.8 mg per puff of wet total particulate matter under FTC smoking conditions, for at least 6 puffs.

74. A cigarette-type smoking article comprising:

(a) a carbonaceous fuel element at the lighting end of the article, being less than about 20 mm in length prior to smoking;

(b) a physically separate aerosol generating means longitudinally disposed behind the fuel element, containing at least one aerosol forming substance;

(c) a container longitudinally disposed behind the fuel element, enclosing the aerosol generating means, and permitting passage of air and the aerosol forming substance;

(d) a fibrous insulating member circumscribing at least a portion of the fuel element;

(e) a charge of tobacco located between the mouthend of the fuel element and the mouthend of the article;

(f) a mouthend piece including a filter, located between the container and the mouthend of the article; and (g) a paper wrapper circumscribing the entire outer longitudinal periphery of the article or any portion thereof.

75. The smoking article of claim 74, wherein the container overlaps the rear portion of the fuel element.

76. The smoking article of claim 74, wherein the container contacts the fuel element.

77. The smoking article of claim 74, 75, or 76 wherein the fuel element is less than 15 mm in length prior to smoking.

78. The smoking article of claim 77, wherein the fuel element contains at least about 80% carbon by weight and is provided with a plurality of longitudinal passageways.

79. The smoking article of claim 74, 75, or 76, wherein the fuel element has a diameter between about 4 to 6 mm.

80. The smoking article of claim 74, wherein the tobacco charge circumscribes at least a portion of the container.

81. The smoking article of claim 74, 75, 76 or 80, wherein the insulating member is a resilient layer at least 1 mm thick which comprises inorganic fibers.

82. The smoking article of claim 81, wherein the fibers fuse during use.

83. The smoking article of claim 74, 75, 76 or 80, wherein the aerosol generating means comprises an alumina substrate which contains the aerosol forming material.

* * * * *